US011245197B2

(12) United States Patent
Liu et al.

(10) Patent No.: US 11,245,197 B2
(45) Date of Patent: Feb. 8, 2022

(54) WIRELESS TRANSCEIVER APPARATUS AND BASE STATION

(71) Applicant: Huawei Technologies Co., Ltd., Shenzhen (CN)

(72) Inventors: Chuan Liu, Chengdu (CN); Changshun Deng, Chengdu (CN); Ke Long, Chengdu (CN); Shuchen Zhao, Chengdu (CN); Biao Feng, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 204 days.

(21) Appl. No.: 16/257,916

(22) Filed: Jan. 25, 2019

(65) Prior Publication Data

US 2019/0157768 A1 May 23, 2019

Related U.S. Application Data

(63) Continuation of application No. PCT/CN2016/091956, filed on Jul. 27, 2016.

(51) Int. Cl.

| | |
|---|---|
| ***H01Q 1/24*** | (2006.01) |
| ***H01Q 19/00*** | (2006.01) |
| ***H01Q 21/20*** | (2006.01) |
| ***H01Q 5/385*** | (2015.01) |
| ***H01Q 9/04*** | (2006.01) |

(52) U.S. Cl.

CPC ..... *H01Q 19/005* (2013.01); *H01Q 1/246* (2013.01); *H01Q 5/385* (2015.01); *H01Q 9/0407* (2013.01); *H01Q 9/0421* (2013.01); *H01Q 21/205* (2013.01)

(58) Field of Classification Search

CPC .... H01Q 19/005; H01Q 21/205; H01Q 5/385; H01Q 9/0407; H01Q 9/0421; H01Q 1/246; H01Q 1/46; H01Q 1/48; H01Q 9/0428; H01Q 21/00

See application file for complete search history.

(56) References Cited

U.S. PATENT DOCUMENTS

| | | | | |
|---|---|---|---|---|
| 5,146,232 | A * | 9/1992 | Nishikawa | H01Q 1/32 343/713 |
| 6,297,777 | B1 | 10/2001 | Tsubaki et al. | |
| 6,426,723 | B1 * | 7/2002 | Smith | H01Q 1/2258 343/700 MS |
| 7,443,347 | B2 * | 10/2008 | Mei | H01Q 1/24 343/700 MS |
| 9,830,547 | B2 | 11/2017 | Pudenz | |

(Continued)

FOREIGN PATENT DOCUMENTS

| | | | |
|---|---|---|---|
| CN | 101165968 | A | 4/2008 |
| CN | 101189756 | A | 5/2008 |

(Continued)

*Primary Examiner* — Dieu Hien T Duong
(74) *Attorney, Agent, or Firm* — Slater Matsil, LLP

(57) ABSTRACT

The present invention discloses a wireless transceiver apparatus and a base station, and pertains to the communications field. The wireless transceiver apparatus includes: a metal carrier and an antenna unit. The antenna unit includes a feeding structure and a radiation patch, where a groove is disposed on the metal carrier, and the antenna unit is disposed in the groove; and the radiation patch is fed by using the feeding structure, and the radiation patch is grounded.

20 Claims, 22 Drawing Sheets

(56) References Cited

U.S. PATENT DOCUMENTS

| | | | | |
|---|---|---|---|---|
| 2006/0227052 | A1 | 10/2006 | Hozouri | |
| 2008/0122722 | A1 | 5/2008 | Chang et al. | |
| 2009/0303133 | A1 | 12/2009 | Ueki | |
| 2011/0221648 | A1 | 9/2011 | Lee et al. | |
| 2014/0091983 | A1* | 4/2014 | Nakano ..... | H01Q 1/52 343/906 |
| 2015/0156818 | A1 | 6/2015 | Kim et al. | |
| 2016/0079654 | A1 | 3/2016 | Wang et al. | |
| 2016/0204519 | A1 | 7/2016 | Lafleur et al. | |

FOREIGN PATENT DOCUMENTS

| | | | |
|---|---|---|---|
| CN | 103178338 | A | 6/2013 |
| CN | 103531895 | A | 1/2014 |
| CN | 104953291 | A | 9/2015 |
| CN | 205122771 | U | 3/2016 |
| EP | 1372216 | A2 | 12/2003 |
| EP | 3046182 | A1 | 7/2016 |
| EP | 3217472 | A1 | 9/2017 |
| GB | 2444164 | A | 5/2008 |
| JP | 2001085934 | A | 3/2001 |
| JP | 2004072731 | A | 3/2004 |
| JP | 2008536403 | A | 9/2008 |
| JP | 2009033294 | A | 2/2009 |
| JP | 2010167863 | A | 8/2010 |
| JP | 2015531190 | A | 10/2015 |
| WO | 2008072411 | A1 | 6/2008 |

* cited by examiner

WIRELESS TRANSCEIVER APPARATUS AND BASE STATION

CROSS-REFERENCE TO RELATED APPLICATIONS

This application is a continuation of International Application No. PCT/CN2016/091956, filed on Jul. 27, 2016, the disclosure of which is hereby incorporated by reference in its entirety.

TECHNICAL FIELD

The present invention relates to the communications field, and in particular, to a wireless transceiver apparatus and a base station.

BACKGROUND

In a mobile communications system, a wireless transceiver apparatus is a common signal transceiver apparatus, and mainly includes structures such as an antenna unit, a dielectric substrate, a shielding cover, and a metal carrier. An antenna unit disposed on the wireless transceiver apparatus is generally an omnidirectional antenna unit, so as to enable the wireless transceiver apparatus to provide a large signal coverage area. The omnidirectional antenna unit shows a homogeneous radiation of 360° in a horizontal directivity pattern, that is, non-direction, and shows a beam with a width in a vertical directivity pattern.

A conventional omnidirectional antenna unit is generally a three-dimensional structure including a radiation patch, a short-circuit probe, and a feeding probe. The omnidirectional antenna unit is disposed on a metal carrier or a shielding cover.

However, the conventional omnidirectional antenna unit is an independent part that needs to be separately processed and assembled on the metal carrier or the shielding cover. In this way, when the omnidirectional antenna unit is disposed on the shielding cover, a total thickness of the wireless transceiver apparatus is a total thickness of the metal carrier, the shielding cover, and the omnidirectional antenna unit that are superposed; or when the omnidirectional antenna unit is disposed on the metal carrier, a total thickness of the wireless transceiver apparatus is a total thickness of the metal carrier and the omnidirectional antenna unit that are superposed. Therefore, the total thickness of the conventional wireless transceiver apparatus is relatively large, and a total volume is relatively large. Correspondingly, relatively large space is occupied.

SUMMARY

To resolve a problem that a wireless transceiver apparatus occupies relatively large space, embodiments of the present invention provide a wireless transceiver apparatus and a base station. Technical solutions are as follows:

According to an aspect, a wireless transceiver apparatus is provided. The wireless transceiver apparatus includes a metal carrier and at least one antenna unit, where the antenna unit includes a feeding structure and a radiation patch. The wireless transceiver apparatus further includes a groove is disposed on the metal carrier, and the antenna unit is disposed in the groove. The radiation patch is fed by using the feeding structure, and the radiation patch is grounded.

According to the wireless transceiver apparatus provided in this embodiment of the present invention, an antenna unit is disposed in a groove of a metal carrier, so that a total thickness of the wireless transceiver apparatus is reduced, and a total volume is reduced, thereby reducing space occupied by the wireless transceiver apparatus.

Optionally, the groove is located on an edge of the metal carrier. An antenna unit located in the groove has better electromagnetic radiation performance.

In actual application, electromagnetic oscillation (also referred to as resonance) can be generated between the radiation patch and a bottom surface of the groove. Optionally, the groove may be located on a corner of the metal carrier, or on a side of the metal carrier. An opening may exist on a side wall of the groove. An antenna unit located in the groove that has an opening on a side wall has a better radiation feature.

Optionally, at least one groove is disposed on the metal carrier, and one antenna unit is disposed in each groove. That is, grooves and antenna units may be disposed in a one-to-one correspondence.

Further, a slot exists between the feeding structure and the radiation patch, and the feeding structure performs coupling feeding on the radiation patch by using the slot.

According to the wireless transceiver apparatus provided in this embodiment of the present invention, a feeding structure performs coupling feeding on a radiation patch by using a slot, so that a bandwidth of an antenna unit can be effectively extended.

Further, the antenna unit may further include a parasitic structure, where the parasitic structure is located on a surface parallel to a bottom surface of the groove, and the parasitic structure is grounded. By adding a parasitic structure, a bandwidth of an antenna unit can be further extended.

Optionally, a slot exists between the parasitic structure and the radiation patch, and the parasitic structure performs coupling feeding on the radiation patch by using the slot. The parasitic structure performs coupling feeding on the radiation patch by using the slot, so that a bandwidth of an antenna unit can be effectively extended while occupying a relatively small volume.

Optionally, the antenna unit may further include a first ground pin. One end of the first ground pin is connected to the parasitic structure, the other end of the first ground pin is connected to the metal carrier, the first ground pin is perpendicular to the bottom surface of the groove, and the parasitic structure is grounded by using the metal carrier. The parasitic structure can be effectively grounded by using the first ground pin.

Further, the parasitic structure may also be a non-centrosymmetric structure. The parasitic structure may have multiple shapes. Optionally, the parasitic structure is a sector structure, the radiation patch is a semi-annular structure, and a center of the radiation patch and a center of the parasitic structure are located on a same side of the radiation patch. Optionally, the two centers are close to a corner on which the antenna unit is disposed, so that an overall size of the antenna unit can be reduced.

It should be noted that a radiation patch in an antenna unit on which no parasitic structure is disposed may be a semi-annular structure or another non-centrosymmetric structure. This is not limited in this embodiment of the present invention.

Optionally, both the radiation patch and the feeding structure are non-centrosymmetric structures. Because both the radiation patch and the feeding structure are non-centrosymmetric structures, when the antenna unit is not disposed on a central position of a metal carrier, a high roundness feature of the antenna unit can still be ensured, and general applicability of the antenna unit can be improved.

It should be noted that because the radiation patch, the feeding structure, and the parasitic structure are all non-centrosymmetric structures, when the antenna unit is not disposed on a central position of a metal carrier. Further, a high roundness feature of the antenna unit can still be ensured, and general applicability of the antenna unit can be improved.

Optionally, the feeding structure may have multiple forms.

In a first possible implementation, the feeding structure is an E-shaped structure, the E-shaped structure is formed by one first vertical strip structure and three first horizontal strip structures whose ends on one side are disposed on the first vertical strip structure at intervals. An opening of the E-shaped structure is disposed opposite to the radiation patch, a length of a first horizontal strip structure located in the middle of the E-shaped structure is greater than a length of each of the other two first horizontal strip structures, the other end of the first horizontal strip structure located in the middle of the E-shaped structure is connected to a feed of the metal carrier, and the slot is formed between the first vertical strip structure and the radiation patch. The feed, that is, a feed source may be a signal transmission port of the metal carrier, and is usually connected to an input/output port of a transceiver.

In a second possible implementation, the feeding structure is a T-shaped structure, the T-shaped structure is formed by one second vertical strip structure and one second horizontal strip structure whose one end extends from a middle part of the second vertical strip structure, the other end of the second horizontal strip structure is connected to a feed of the metal carrier, and the slot is formed between the second vertical strip structure and the radiation patch.

In a third possible implementation, the feeding structure is an integrated structure formed by an arc-shaped structure and a strip structure, one end of the strip structure is connected to a feed of the metal carrier, and the other end of the strip structure is connected to the arc-shaped structure. An arc-shaped opening is disposed on a side that is of the radiation patch and that is close to the feeding structure. The arc-shaped structure is located in the arc-shaped opening, and the slot is formed between the arc-shaped structure and the arc-shaped opening.

Optionally, the antenna unit further includes a dielectric substrate, the dielectric substrate is disposed in the groove, and both the radiation patch and the feeding structure are disposed on the dielectric substrate. The dielectric substrate may effectively bear the radiation patch and the feeding structure to ensure that a slot is formed between the radiation patch and the bottom surface of the groove, so that electromagnetic oscillation is generated between the radiation patch and the bottom surface of the groove.

In addition to the parasitic structure, optionally, the antenna unit further includes a ground cable. One end of the ground cable is connected to the radiation patch, and the other end of the ground cable is connected to a metal ground cable disposed on the dielectric substrate, so that the radiation patch is grounded by using the metal ground cable. The radiation patch can be effectively grounded by using the ground cable.

Optionally, there may be multiple possible implementations for disposing of the ground cable.

In a first possible implementation, the ground cable is disposed on a side of the radiation patch, and the feeding structure is disposed on another side of the radiation patch.

In a second possible implementation, there are two ground cables. The two ground cables are symmetrically disposed on two sides of the radiation patch, and are separately connected to the metal ground cable of the dielectric substrate; the feeding structure is an axisymmetric structure; and a symmetry axis of the feeding structure is the same as a symmetry axis of the two ground cables.

In a possible implementation, when the antenna unit includes a dielectric substrate, the radiation patch may be located on a lower surface of the dielectric substrate. The wireless transceiver apparatus further includes a second ground pin disposed on at least one side of the radiation patch. One end of the second ground pin is connected to the radiation patch, the other end of the second ground pin is connected to the metal carrier. The second ground pin is perpendicular to a surface of the dielectric substrate. The surface of the dielectric substrate is parallel to the bottom surface of the groove, and the radiation patch is grounded by using the metal carrier.

In another possible implementation, when the antenna unit does not include a dielectric substrate. The wireless transceiver apparatus may further include a second ground pin disposed on at least one side of the radiation patch. One end of the second ground pin is connected to the radiation patch, and the other end of the second ground pin is connected to the metal carrier. The second ground pin is perpendicular to a bottom surface of the groove, and the radiation patch is grounded by using the metal carrier.

Optionally, a dielectric substrate is further disposed on the metal carrier, and the dielectric substrate of the antenna unit and the dielectric substrate on the metal carrier are an integrated structure. When the dielectric substrate and the dielectric substrate on the metal carrier are an integrated structure, an antenna unit does not need to be separately processed or installed, so that complexity of a manufacturing process of the wireless transceiver apparatus is reduced, and assembly costs are reduced.

Optionally, the wireless transceiver apparatus further includes a shielding cover, where the shielding cover is buckled on the dielectric substrate on the metal carrier. The shielding cover can effectively shield electromagnetic interference of an external environment for an electronic component inside the metal carrier.

Optionally, a heat sink fin is disposed on a bottom of the metal carrier, so as to ensure effective heat dissipation for the metal carrier.

Optionally, the feeding structure may include: a first feeding sub-structure perpendicular to the bottom surface of the groove, and a second feeding sub-structure parallel to the bottom surface of the groove, where the first feeding sub-structure is connected to a feed of the metal carrier.

It should be noted that a shape of the second feeding sub-structure may be the same as a shape of the foregoing E-shaped structure or T-shaped structure, and a difference is that the second feeding sub-structure may be connected to a feed by using the first feeding sub-structure.

According to another aspect, a base station is provided, including any one of the foregoing wireless transceiver apparatuses.

According to the wireless transceiver apparatus provided in the embodiments of the present invention, an antenna unit is disposed in a groove of a metal carrier, so that a total thickness of the wireless transceiver apparatus is reduced, and a total volume is reduced, thereby reducing space occupied by the wireless transceiver apparatus.

BRIEF DESCRIPTION OF THE DRAWINGS

The following briefly describes the accompanying drawings required for describing the embodiments. Apparently, the accompanying drawings in the following description show merely some embodiments of the present invention, and persons of ordinary skill in the art may still derive other drawings from these accompanying drawings without creative efforts.

FIG. 3-1 is a schematic structural diagram of a wireless transceiver apparatus according to an embodiment of the present invention;

FIG. 3-2 is a schematic diagram of a partial structure of a wireless transceiver apparatus according to an embodiment of the present invention;

FIG. 4-1 is a schematic diagram of a partial structure of another wireless transceiver apparatus according to an embodiment of the present invention;

FIG. 4-2 is a schematic diagram of a partial structure of still another wireless transceiver apparatus according to an embodiment of the present invention;

DETAILED DESCRIPTION OF ILLUSTRATIVE EMBODIMENTS

The following further describes the embodiments of the present invention in detail with reference to the accompanying drawings.

Figure 1:
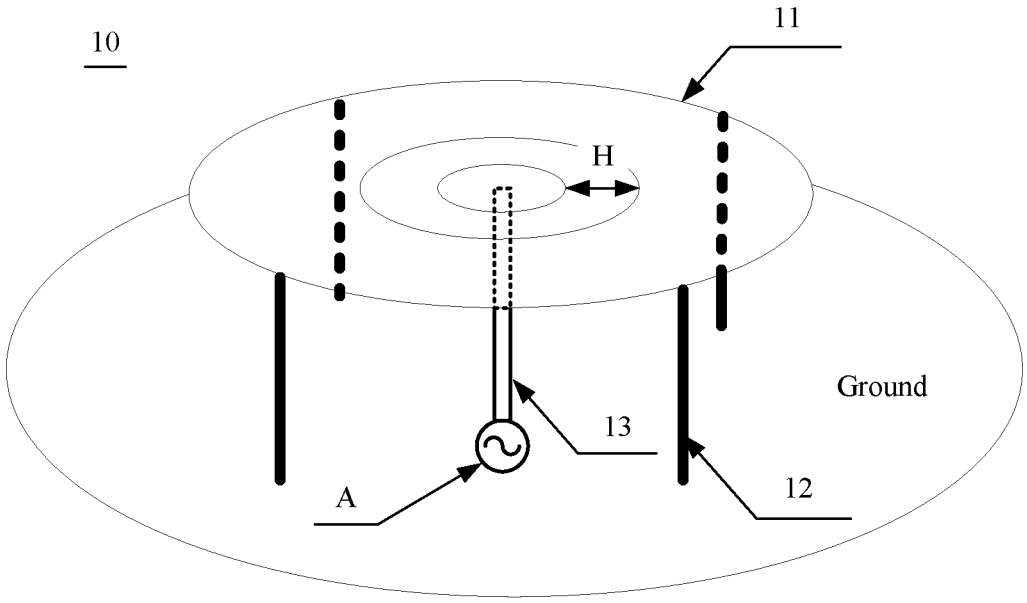
FIG. 1 (Prior Art)
FIG. 1 is a schematic structural diagram of a frequently-used omnidirectional antenna unit according to the related art.

FIG. 1 is a frequently-used omnidirectional antenna unit 10 provided in current systems. The omnidirectional antenna unit may be referred to as a wideband monopole antenna unit. As shown in FIG. 1, the omnidirectional antenna unit 10 includes a radiation patch 11; a short-circuit probe 12 whose one end is connected to the radiation patch 11, and the other end is grounded; and a feeding probe 13, where one end of the feeding probe 13 is grounded, and a slot H is formed between the other end of the feeding probe 13 and the radiation patch 11. The feeding probe 13 feeds the radiation patch 11 by using the slot H, and a feeding point is point A.

Figure 2:
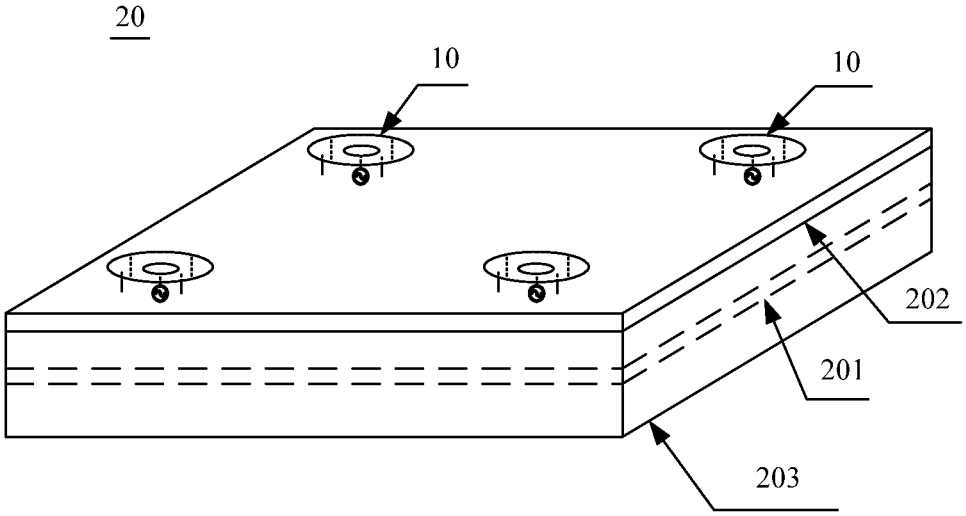
FIG. 2 (Prior Art)
FIG. 2 is a schematic structural diagram of a frequently-used wireless transceiver apparatus according to the related art.

Because the omnidirectional antenna unit is a three-dimensional structure, a wireless transceiver apparatus including the omnidirectional antenna unit may be shown in FIG. 2. FIG. 2 is a schematic structural diagram of a conventional wireless transceiver apparatus 20. The wireless transceiver apparatus 20 includes at least one omnidirectional antenna unit 10, a dielectric substrate 201, a shielding cover 202, and a metal carrier 203. The metal carrier 203 is a housing, the dielectric substrate 201 is disposed on the metal carrier 203, the shielding cover 202 is buckled on the metal carrier, and the omnidirectional antenna unit 10 is formed on the shielding cover 202 or the metal carrier 203. In FIG. 2, an example in which the omnidirectional antenna unit 10 is formed on the shielding cover 202 is used for description. In the conventional wireless transceiver apparatus, the omnidirectional antenna unit 10 is a separately processed three-dimensional structure, and is disposed on the shielding cover 202 or the metal carrier 203 after processing is completed. When the omnidirectional antenna unit is disposed on the shielding cover, a total thickness of the wireless transceiver apparatus is a total thickness of the metal carrier, the shielding cover, and the omnidirectional antenna unit that are superposed. When the omnidirectional antenna unit is disposed on the metal carrier, a total thickness of the wireless transceiver apparatus is a total thickness of the metal carrier and the omnidirectional antenna unit that are superposed. Therefore, the total thickness of the conventional wireless transceiver apparatus is relatively large, and a total volume is relatively large.

Figures 1, 3:
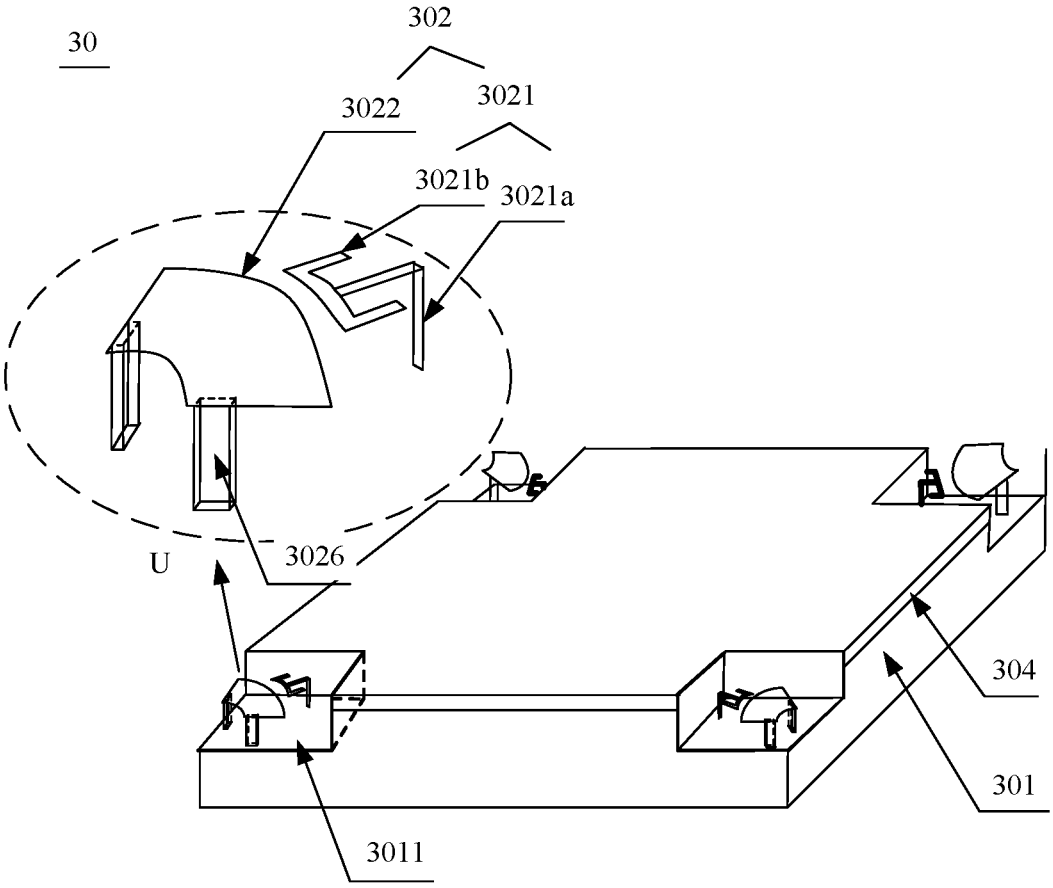
Figures 2, 3:
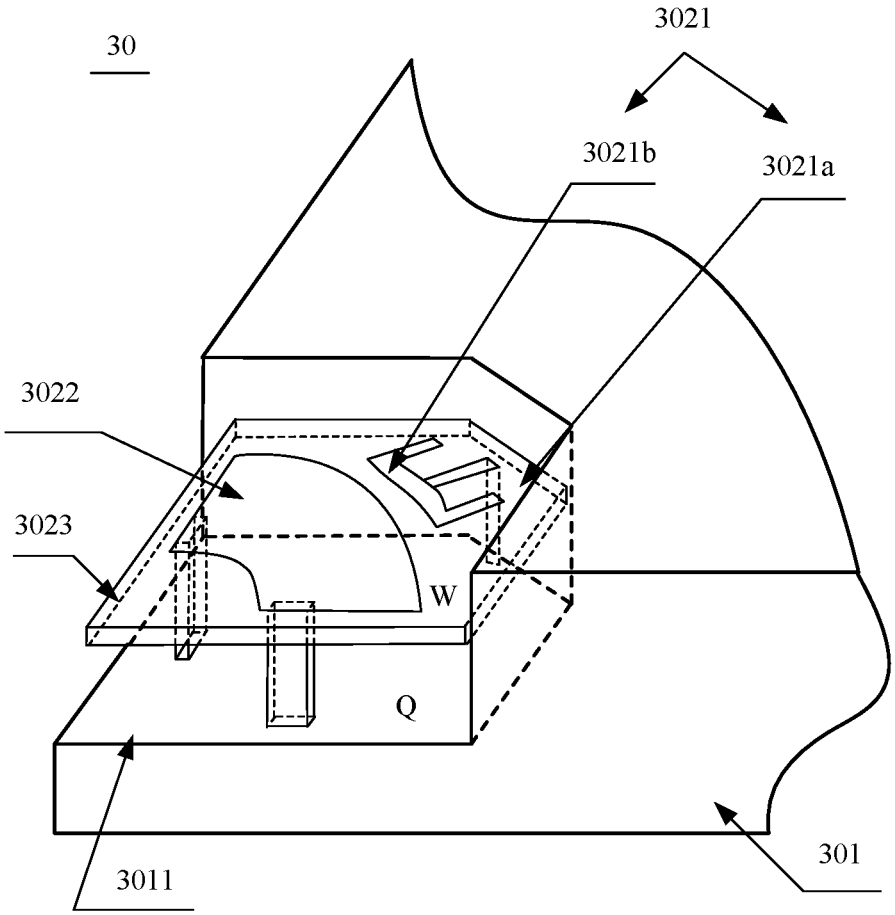

FIG. 3-1 is a schematic structural diagram of a wireless transceiver apparatus 30 according to an embodiment of the present invention. As shown in FIG. 3-1, the wireless transceiver apparatus 30 may include a metal carrier 301 and at least one antenna unit 302.

A groove 3011 is disposed on the metal carrier 301. The groove 3011 may be disposed on an edge of the metal carrier 301. Optionally, the groove 3011 may be located on a corner of the metal carrier 301, or on a side of the metal carrier 301. The antenna unit 302 is disposed in the groove 3011. In this embodiment of the present invention, that the antenna unit is disposed in the groove means that all or a part of the antenna unit is disposed in the groove, and generally, an orthographic projection of the antenna unit on a bottom surface of the groove is located in the groove. As shown in a dashed box U in FIG. 3-1, in the dashed box U, there is an enlarged view of an antenna unit 302 disposed on an edge of the metal carrier 301. The antenna unit 302 includes a feeding structure 3021 and a radiation patch 3022. The radiation patch 3022 is fed by using the feeding structure 3021, and the radiation patch 3022 is grounded. It should be noted that the metal carrier in this embodiment of the present invention may have multiple structures. The metal carrier can be used as a reference ground of the antenna unit, and the metal carrier may be a metal housing of the wireless transceiver apparatus, a circuit board (for example, a dielectric substrate), a heat sink, or the like.

In actual application, electromagnetic oscillation (also referred to as resonance) can be generated between the radiation patch 3022 and a bottom surface of the groove. Generally, a capacitance and an inductance are generated between the radiation patch and the bottom surface of the groove, and electromagnetic oscillation is excited by the capacitance and the inductance.

Optionally, at least one groove 3011 is disposed on the metal carrier, and one antenna unit 302 is disposed in each groove 3011. That is, grooves and antenna units may be disposed in a one-to-one correspondence, and a quantity of the grooves is equal to a quantity of the antenna units. As shown in FIG. 3-1, four grooves 3011 are disposed in FIG. 3-1. Correspondingly, one antenna unit 302 is disposed in each groove 3011; that is, there are four antenna units 302. When at least two grooves are disposed on the metal carrier, structures of antenna units disposed in the at least two grooves may be the same, or may be different. This is not limited in this embodiment of the present invention.

According to the wireless transceiver apparatus provided in this embodiment of the present invention, an antenna unit is disposed in a groove of a metal carrier, so that a total thickness of the wireless transceiver apparatus is reduced, and a total volume is reduced, thereby reducing space occupied by the wireless transceiver apparatus.

Further, as shown in FIG. 3-2, the antenna unit 302 may further include a dielectric substrate 3023. FIG. 3-2 may be considered as a schematic structural diagram obtained after a dielectric substrate is added to the antenna unit that is shown in the dashed box U in FIG. 3-1. Optionally, the dielectric substrate may be an epoxy resin plate FR-4, and a dielectric constant of the epoxy resin plate FR-4 is 4.2. Alternatively, the dielectric substrate may be made from another material.

The dielectric substrate 3023 is disposed in the groove 3011, and is configured to bear the radiation patch 3022 and the feeding structure 3021; that is, the radiation patch 3022 is disposed on the dielectric substrate 3023. Electromagnetic oscillation can be generated between the radiation patch 3022 and a bottom surface of the groove 3011. In actual application, the radiation patch 3022 is laminated on a surface W of the dielectric substrate 3023. For example, either of two surfaces of the dielectric substrate 3023 that have the largest surface area. A surface of the radiation patch is parallel to a surface Q on which the antenna unit 302 is disposed, and a capacitance may be generated between the two parallel surfaces. All or a part of the feeding structure 3021 may be disposed on the dielectric substrate 3023.

Optionally, a dielectric substrate (also referred to as a radio frequency board) 303 may be further disposed on the metal carrier 301, and the dielectric substrate 3023 of the antenna unit 302 and the dielectric substrate 303 on the metal carrier 301 may be an integrated structure.

It may be learned from the foregoing that, according to the wireless transceiver apparatus provided in this embodiment of the present invention, a radiation patch is fed by using a feeding structure of an antenna unit to implement a feature of the antenna unit, and the radiation patch and the feeding structure are further disposed on a dielectric substrate. When the dielectric substrate and a dielectric substrate on a metal carrier are an integrated structure, the antenna unit does not need to be separately processed or installed, so that complexity of a manufacturing process of the wireless transceiver apparatus is reduced, and assembly costs are reduced. Further, the radiation patch and the feeding structure of the antenna unit are similar to a planar structure. Therefore, compared with a three-dimensional structure in the related art, a total volume of the antenna unit is reduced, thereby reducing space occupied by the wireless transceiver apparatus.

In actual application, the feeding structure may feed the radiation patch in multiple manners, such as direct-connection feeding or coupling feeding. When the feeding structure is in direct contact with the radiation patch, the feeding structure performs direct-connection feeding on the radiation patch. In this feeding manner, an antenna unit can obtain a relatively low standing wave bandwidth, and an implementation is simple. However, a bandwidth of the antenna unit can be extended by means of coupling feeding.

For a conventional omnidirectional antenna unit, for example, the omnidirectional antenna unit 10 shown in FIG. 1, because of a structure of the omnidirectional antenna unit, when multiple antenna units are arranged on the wireless transceiver apparatus, or when the metal carrier is asymmetric, relatively high antenna pattern roundness can be maintained in only a narrowband range, and relatively low antenna pattern roundness is maintained in a wideband range. A directivity pattern is short for an antenna unit directivity pattern, and refers to a pattern that shows how relative field strengths (normalized modulus values) in a radiation field change with directions at a distance from the antenna unit. Changes of the radiation field are usually represented by using directivity patterns of two mutually perpendicular planes in a direction that has highest radiation power and that is of the antenna unit. The antenna unit directivity pattern is an important pattern for measuring performance of the antenna unit, and parameters of the antenna unit may be observed from the antenna unit directivity pattern. The antenna pattern roundness is also referred to as antenna pattern non-roundness, and refers to a difference between a maximum value and a minimum value of levels (unit: dB) in each direction of the antenna unit in a horizontal directivity pattern.

Figures 1, 4:
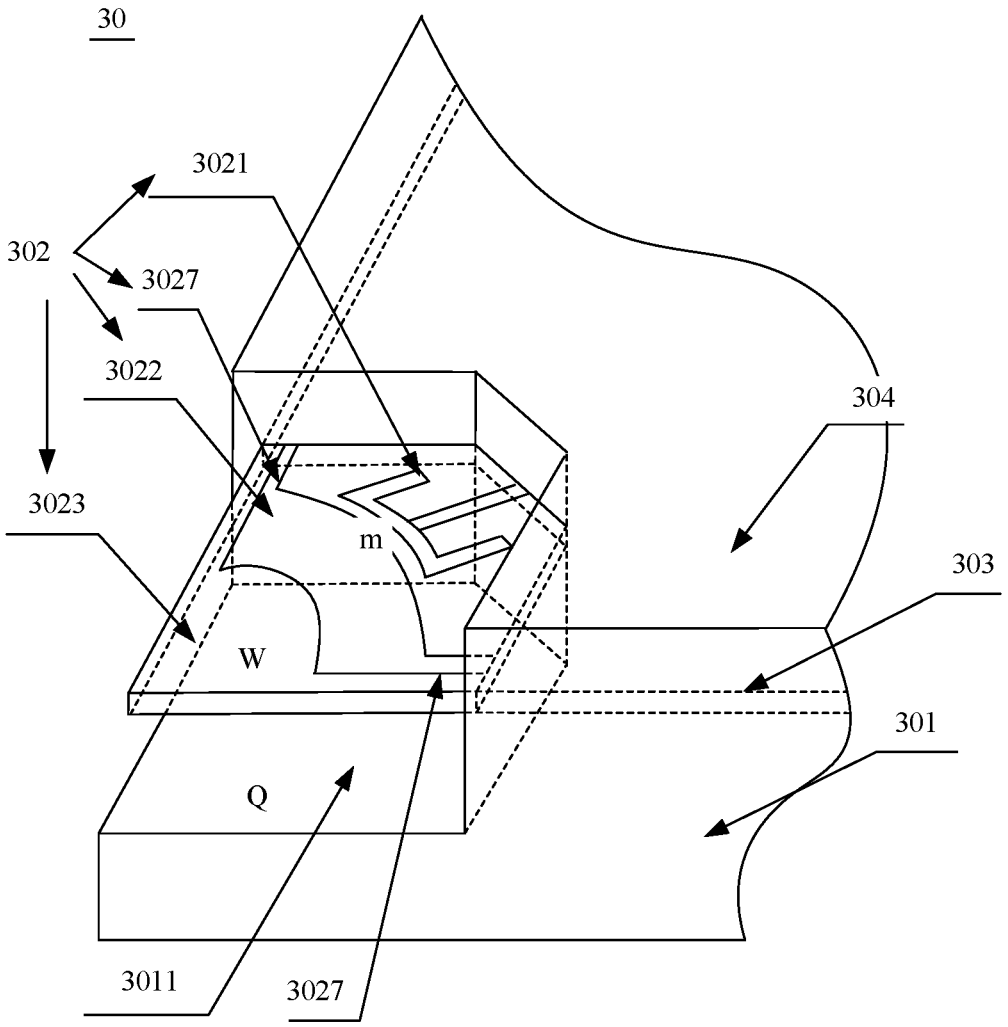
Figures 2, 4:
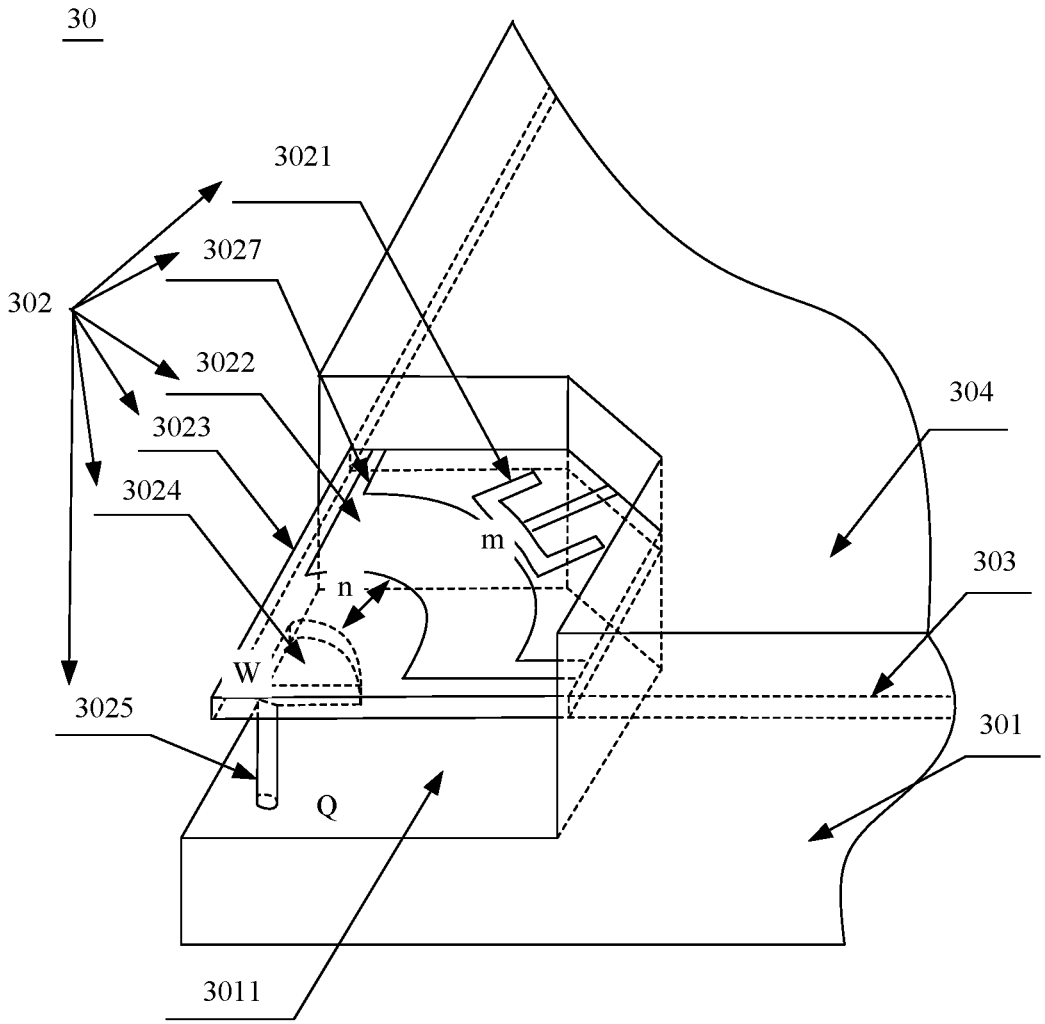

To enable the antenna unit 302 to obtain a relatively high standing wave bandwidth, in this embodiment of the present invention, as shown in FIG. 4-1, a slot m may exist between the feeding structure 3021 and the radiation patch 3022. For example, a slot m may exist between an orthographic projection of the feeding structure 3021 on a surface of the radiation patch 3022 and the radiation patch 3022. Alternatively, an overlapping region may exist between an orthographic projection of the feeding structure 3021 on a surface of the radiation patch 3022 and the radiation patch 3022, but the feeding structure 3021 and the radiation patch 3022 are not coplanar or laminated together, so that a slot m is generated. The feeding structure 3021 performs coupling feeding on the radiation patch 3022 by using the slot m. Further, as shown in FIG. 4-2, the antenna unit 302 may further include a parasitic structure 3024. The parasitic structure 3024 is located on a surface parallel to a bottom surface of the groove. For example, the parasitic structure 3024 may be supported by some support structures, and be disposed on the surface parallel to the bottom surface of the groove; or may be directly disposed on a surface of the dielectric substrate 3023, and the dielectric substrate is parallel to the bottom surface of the groove. The parasitic structure 3024 is grounded. A slot n exists between the radiation patch 3022 and the parasitic structure 3024, so that the radiation patch 3022 can perform coupling feeding on the parasitic structure 3024. When the parasitic structure performs coupling feeding on the radiation patch, electromagnetic oscillation may be generated between the parasitic structure and the bottom surface of the groove. The parasitic structure is added to the antenna unit based on the radiation patch. Electromagnetic oscillation can be generated between the parasitic structure and the bottom surface of the groove, and between the radiation patch and the bottom surface of the groove. An overall resonance area of the antenna unit is in positive correlation with a bandwidth of the antenna unit. Therefore, when the parasitic structure performs coupling feeding on the radiation patch, a bandwidth of the antenna unit can be further extended while ensuring a relatively small volume of the antenna unit.

Figure 5:
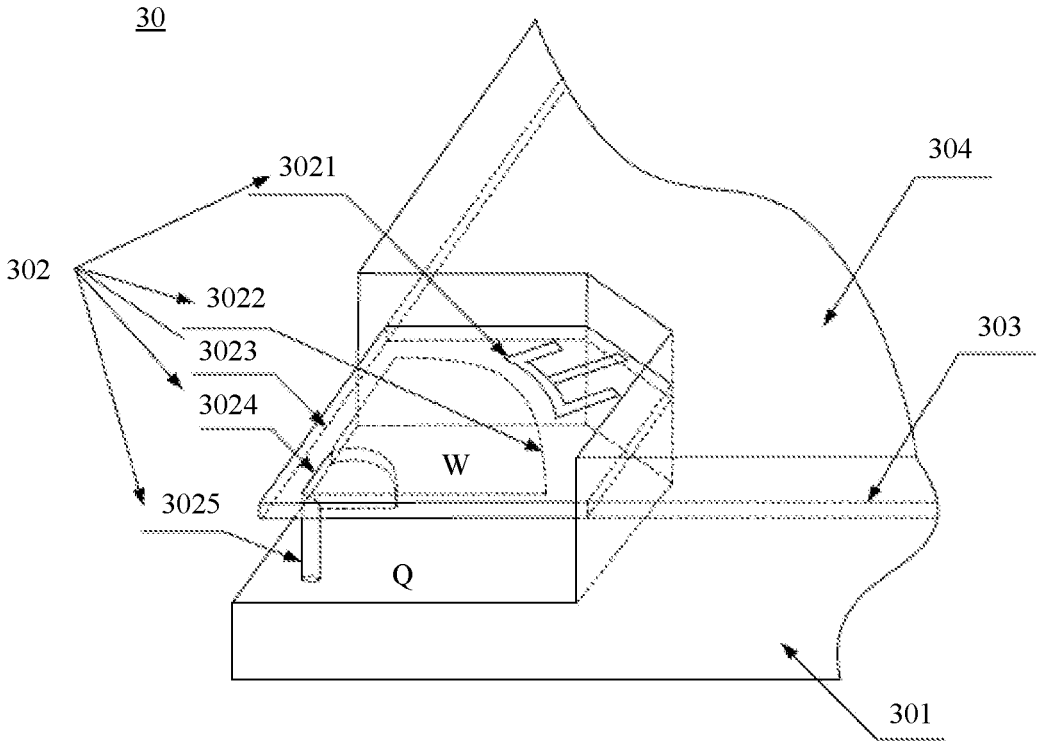
FIG. 5 is a schematic diagram of a partial structure of a wireless transceiver apparatus according to an embodiment of the present invention.

Optionally, as shown in FIG. 4-2 or FIG. 5, the antenna unit 302 may further include a first ground pin 3025. One end of the first ground pin 3025 is connected to the parasitic structure 3024, the other end of the first ground pin 3025 is connected to the metal carrier 301, the first ground pin 3025 is perpendicular to the bottom surface Q of the groove, and the parasitic structure 3024 is grounded by using the metal carrier 301. The parasitic structure may be disposed parallel to the bottom surface of the groove, so that a capacitance is generated between the parasitic structure and the bottom surface of the groove; and then the first ground pin is disposed, so that an inductance is generated between the parasitic structure and the bottom surface of the groove, and then electromagnetic oscillation is excited. In addition, the first ground pin not only enables the parasitic structure to be electrically connected to the metal carrier across a relatively short path, but also can support the dielectric substrate to avoid deformation of the dielectric substrate. A manufacturing technology of the first ground pin is relatively simple.

In this embodiment of the present invention, the parasitic structure may feed the radiation patch in multiple manners, such as direct-connection feeding or coupling feeding. A bandwidth of the antenna unit can be extended in the two feeding manners. As shown in FIG. 5, in FIG. 5, the radiation patch 3022 is in direct contact with the parasitic structure 3024, and the radiation patch 3022 performs direct-connection feeding on the parasitic structure 3024. Optionally, when the radiation patch 3002 is fed in this manner, a ground cable on a side is not required, and the radiation patch 3002 is directly grounded by using the first ground pin 3025 that is connected to the parasitic structure. In addition, by using the first ground pin, a relatively strong inductance may be generated between the radiation patch and the bottom surface of the groove, so as to ensure that electromagnetic oscillation is generated between the radiation patch and the bottom surface of the groove.

As shown in FIG. 4-2, a slot n may exist between the parasitic structure 3024 and the radiation patch 3022. For example, a slot n exists between an orthographic projection of the parasitic structure 3024 on a surface of the radiation patch 3022 and the radiation patch 3022, or an overlapping region may exist between an orthographic projection of the parasitic structure 3024 on a surface of the radiation patch 3022 and the radiation patch 3022, but the parasitic structure 3024 and the radiation patch 3022 are not coplanar or laminated together, so that a slot n is generated. The parasitic structure 3024 performs coupling feeding on the radiation patch 3022 by using the slot n. In the coupling feeding manner, the antenna unit 302 may obtain a relatively high standing wave bandwidth. It should be noted that when the parasitic structure 3024 performs coupling feeding on the radiation patch 3022, the parasitic structure 3024 and the radiation patch 3022 are not in contact with each other. Therefore, the radiation patch 3022 cannot be grounded by using the parasitic structure 3024, and needs to be grounded by using a ground cable or a ground pin.

It should be noted that because of performance of the parasitic structure, for the parasitic structure, an area required in direct-connection feeding manner is greater than an area required in a coupling feeding manner. To reduce a total volume of the antenna unit, the parasitic structure and the radiation patch are usually fed in a coupling feeding manner.

Figure 6:
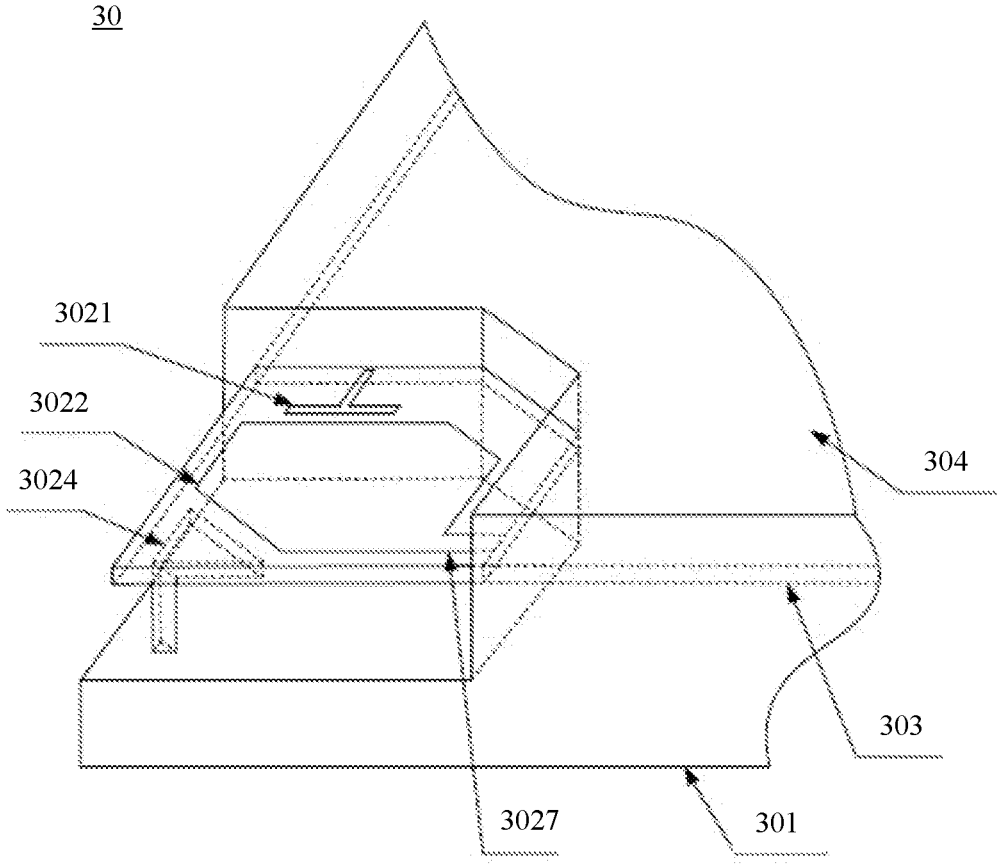
FIG. 6 is a schematic diagram of a partial structure of another wireless transceiver apparatus according to an embodiment of the present invention.

Further, shapes of the parasitic structure 3024 and the radiation patch 3022 may match each other, so as to ensure that the parasitic structure 3024 effectively feeds the radiation patch 3022. For example, in the antenna unit 302, when the parasitic structure 3024 feeds the radiation patch 3022 in a coupling feeding manner, the parasitic structure 3024 and the radiation patch 3022 may match each other, so as to ensure that an appropriate slot exists between the parasitic structure 3024 and the radiation patch 3022. For example, as shown in FIG. 4-2, the parasitic structure 3024 is a sector structure, the radiation patch 3022 is a semi-annular structure, and a center of the radiation patch 3022 and a center of the parasitic structure 3024 are located on a same side of the radiation patch 3022. Optionally, the two centers are close to a corner on which the antenna unit is disposed, so that an overall size of the antenna unit can be reduced. It should be noted that a radiation patch in an antenna unit on which no parasitic structure is disposed may also be a semi-annular structure or another non-centrosymmetric structure. This is not limited in this embodiment of the present invention. As shown in FIG. 6, the parasitic structure 3024 is a triangular structure, the radiation patch 3022 is a polygonal structure, and two sides that are of the radiation patch 3022 and the parasitic structure 3024 and that are close to each other are parallel. For another example, in the antenna unit 302, when the parasitic structure 3024 feeds the radiation patch 3022 in a direct-connection feeding manner, shapes of the parasitic structure 3024 and the radiation patch 3022 may match each other, so as to ensure an effective connection between the parasitic structure 3024 and the radiation patch 3022. For example, as shown in FIG. 5, the parasitic structure 3024 is a sector structure, the radiation patch 3022 is a semi-annular structure, and a center of the radiation patch 3022 and a center of the parasitic structure 3024 are located on a same side of the radiation patch 3022. An outer edge of the sector structure overlaps an inner edge of the semi-annular structure. In FIG. 5, the parasitic structure 3024 and the radiation patch 3022 may be located on a same surface of the dielectric substrate; the parasitic structure 3024 partially overlaps the radiation patch 3022; and the parasitic structure 3024 and the radiation patch 3022 are electrically connected based on contact of the overlapping part. For example, the parasitic structure 3024 and the radiation patch 3022 may be located on a lower surface of the dielectric substrate, and an upper surface of the parasitic structure 3024 partially overlaps a lower surface of the radiation patch 3022.

It should be noted that, for the shapes of the parasitic structure 3024 and the radiation patch 3022, there may be another matching situation. This embodiment of the present invention is used only as an example for description. Any modification, equivalent replacement, or improvement made based on the matching situation provided in the present invention shall fall within the protection scope of the present invention. Therefore, details are not described in this embodiment of the present invention.

Further, the shapes of the feeding structure 3021 and the radiation patch 3022 may match each other, so as to ensure that the feeding structure 3021 effectively feeds the radiation patch 3022. In this embodiment of the present invention, the following three possible implementations are used as examples for description.

In a first possible implementation, as shown in any one of FIG. 4-1 to FIG. 5, the feeding structure 3021 is an E-shaped structure, the E-shaped structure is formed by one first vertical strip structure and three first horizontal strip structures whose ends on one side are disposed on the first vertical strip structure at intervals, an opening of the E-shaped structure is disposed opposite to the radiation patch, a length of a first horizontal strip structure located in the middle of the E-shaped structure is greater than a length of each of the other two first horizontal strip structures, the other end of the first horizontal strip structure located in the middle of the E-shaped structure is connected to a feed of the metal carrier, and the slot is formed between the first vertical strip structure and the radiation patch 3022.

In a second possible implementation, as shown in FIG. 6, the feeding structure 3021 is a T-shaped structure, the T-shaped structure is formed by a second vertical strip structure and one second horizontal strip structure whose one end extends from a middle part of the second vertical strip structure, the other end of the second horizontal strip structure is connected to a feed of the metal carrier, and the slot is formed between the second vertical strip structure and the radiation patch 3022.

Figure 7:
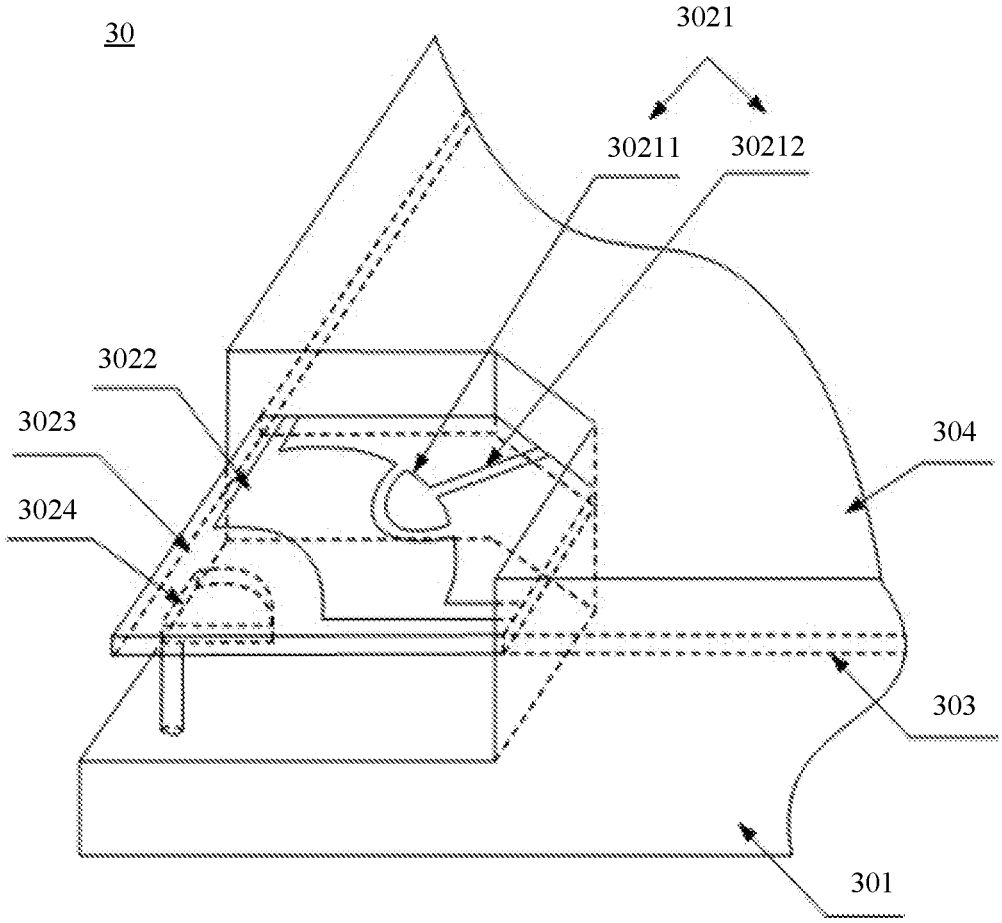
FIG. 7 is a schematic diagram of a partial structure of still another wireless transceiver apparatus according to an embodiment of the present invention.

In a third possible implementation, alternatively, as shown in FIG. 7, the feeding structure 3021 may be an integrated structure formed by an arc-shaped structure 30211 and a strip structure 30212, one end of the strip structure 30212 is connected to a feed of the metal carrier, and the other end of the strip structure 30212 is connected to the arc-shaped structure 30211, an arc-shaped opening is disposed on a side that is of the radiation patch 3022 and that is close to the feeding structure 3021, the arc-shaped structure 30211 matches the arc-shaped opening, the arc-shaped structure 30211 is located in the arc-shaped opening, and the slot used for coupling feeding is formed between the arc-shaped structure 30211 and the arc-shaped opening.

It should be noted that, for the shapes of the feeding structure 3021 and the radiation patch 3022, there may be another matching situation. This embodiment of the present invention is used only as an example for description. Any modification, equivalent replacement, or improvement made based on the matching situation provided in the present invention shall fall within the protection scope of the present invention. Therefore, details are not described in this embodiment of the present invention.

Generally, for a structure of the wireless transceiver apparatus, three types of symmetry relate to roundness: symmetry of an antenna unit, symmetry of an installation position, and symmetry of a metal carrier. If the three types of symmetry are all met, that is, a centrosymmetric omnidirectional antenna unit is centrosymmetrically disposed on a centrosymmetric metal carrier, roundness of the wireless transceiver apparatus is generally relatively high. If one of the three types of symmetry is destroyed, roundness generally becomes lower.

Figure 8:
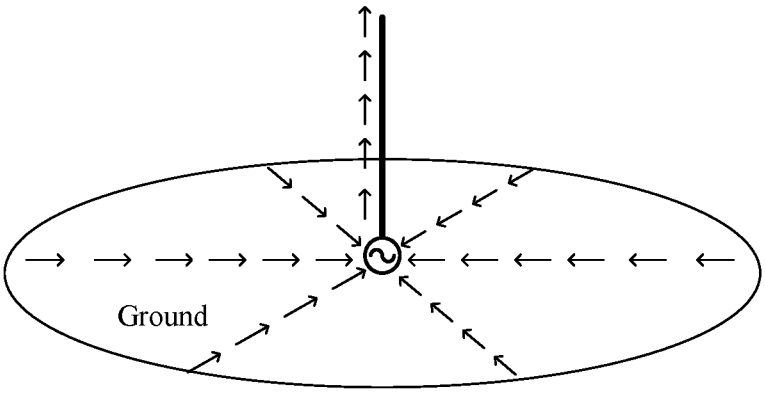
FIG. 8 is a schematic diagram of current distribution of a frequently-used omnidirectional antenna unit according to the related art.

If an omnidirectional antenna unit is installed on a conventional wireless transceiver apparatus, generally, the omnidirectional antenna unit is disposed on a central position of a metal carrier (the metal carrier is equivalent to a reference ground, that is, a ground shown in FIG. 8). For example, the omnidirectional antenna unit is centrosymmetrically disposed on a shielding cover of the wireless transceiver apparatus, and a radiation patch or a radiator of the antenna unit is designed as a centrosymmetric (also referred to as rotationally symmetric) structure. In addition, the antenna unit with a centrosymmetric structure further needs to be placed in the middle of the metal carrier (for example, a ground shown in FIG. 8), so that the antenna unit has similar radiation features on a cross section parallel to the shielding cover based on structure symmetry, thereby achieving high roundness performance. A schematic diagram of corresponding current distribution is shown in FIG. 8. Ground currents of the antenna unit are centrosymmetrically distributed. However, to implement multiband coverage and multichannel signal transmission, generally, at least two omnidirectional antenna units need to be installed on the wireless transceiver apparatus. In this case, when there are multiple antenna units, because it cannot be ensured that a metal carrier is symmetric relative to each antenna unit, non-centrosymmetric distribution of ground currents is inevitably caused, and antenna pattern roundness becomes lower. In actual application, because of processing convenience, the metal carrier is a centrosymmetric structure, for example, a square structure or a circular structure, and a shielding cover buckled on the metal carrier is also a centrosymmetric structure. Optionally, the metal carrier may be a centrosymmetric prismatic structure. For beauty, an edge of the metal carrier may be rounded or beveled.

Figure 9:
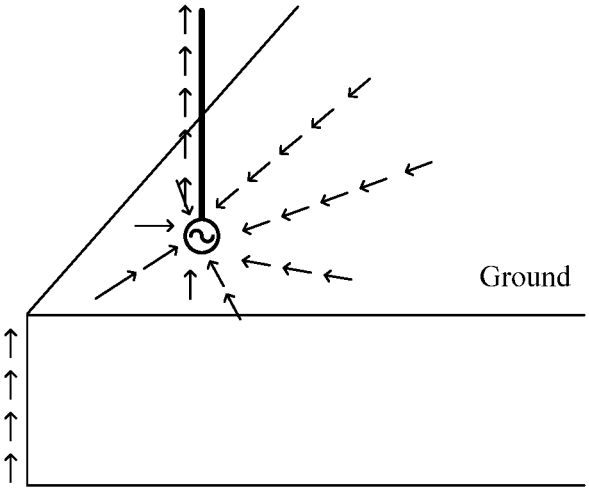
FIG. 9 is a schematic diagram of current distribution of an omnidirectional antenna unit in the wireless transceiver apparatus provided in FIG. 2.
Figure 10:
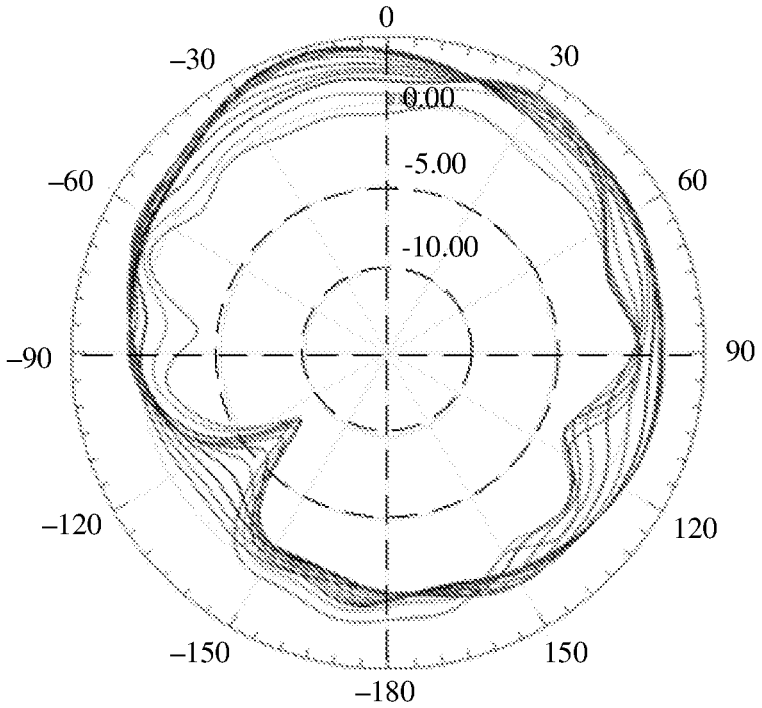
FIG. 10 is an emulation diagram of a directivity pattern of an omnidirectional antenna unit in the wireless transceiver apparatus shown in FIG. 9.

FIG. 9 is a schematic diagram of current distribution of an antenna unit in a scenario that is shown in FIG. 2 and in which omnidirectional antenna units are disposed on four corners of a shielding cover. A metal carrier is used as a reference ground (a ground shown in FIG. 9) of the antenna unit, and the metal carrier is not centrosymmetric relative to each antenna unit, and consequently, ground currents of each antenna unit are non-centrosymmetrically distributed. Correspondingly, an emulation diagram of a directivity pattern of the antenna unit may be shown in FIG. 10. Antenna pattern roundness corresponding to different frequencies in FIG. 10 is shown in Table 1. A cross section of a three-dimension directivity pattern at an angle Theta in a horizontal plane direction is obtained. A value range of Theta is usually 0° to 180°, and a frequency value recorded in Table 1 is a frequency value corresponding to a frequency required when the antenna unit is normally working. Theta cross section roundness represents a difference between a maximum value and a minimum value of levels (unit: dB) in a directivity pattern obtained when an angle is Theta. In addition, for the sake of a coverage area, a cross section of Theta=80° is usually considered. Theta=80° represents that an included angle between a radiation direction and a vertical direction in a polar coordinate system is 80°. It may be learned from the emulation diagram shown in FIG. 10 and Table 1, when conventional wideband monopole antenna units are arranged on four corners of a metal carrier, because an antenna unit is non-centrosymmetrically distributed for the metal carrier, and consequently, ground currents of the metal carrier are non-centrosymmetrically distributed. Therefore, a relatively deep pit of a directivity pattern is formed in an opposite angle direction of the metal carrier, antenna pattern roundness becomes extremely low, and the lowest roundness in a wideband range of 1.7 GHz to 2.7 GHz is 10.9 dB. A fluctuation degree of the directivity pattern far exceeds a fluctuation range that is acceptable to a communications operator. A huge fluctuation in a horizontal cross section directivity pattern will lead to a communications dead zone, and consequently, a coverage area is reduced, and a communication capability is reduced.

TABLE 1

| Frequency (GHz) | Cross section roundness (dB) when Theta = 80° |
|---|---|
| 1.7 | 4.2 |
| 1.9 | 5.8 |
| 2.1 | 7.6 |
| 2.3 | 9.7 |
| 2.5 | 10.9 |
| 2.7 | 8.9 |

In this embodiment of the present invention, to implement multiband coverage and multichannel signal transmission, generally, at least two omnidirectional antenna units need to be installed on the wireless transceiver apparatus. As shown in any one of FIG. 3-1 to FIG. 7, the radiation patch 3022 and the feeding structure 3021 in each antenna unit on the wireless transceiver apparatus in this embodiment of the present invention may be non-centrosymmetric structures. The radiation patch 3022 and the feeding structure 3021 in each antenna unit in this embodiment of the present invention may be non-centrosymmetric structures, the metal carrier is used as a reference ground of the antenna unit, and the metal carrier is non-centrosymmetric relative to each antenna unit. Therefore, for each antenna unit, ground currents generated by a non-centrosymmetric radiation patch and a non-centrosymmetric reference ground may be relatively centrosymmetrically distributed. Compared with the omnidirectional antenna unit in the conventional wireless transceiver apparatus, each antenna unit in the wireless transceiver apparatus provided in this embodiment of the present invention has relatively high roundness in a wideband range. In addition, the parasitic structure may be a non-centrosymmetric structure, so as to further ensure antenna pattern roundness of the antenna unit.

Figure 11:
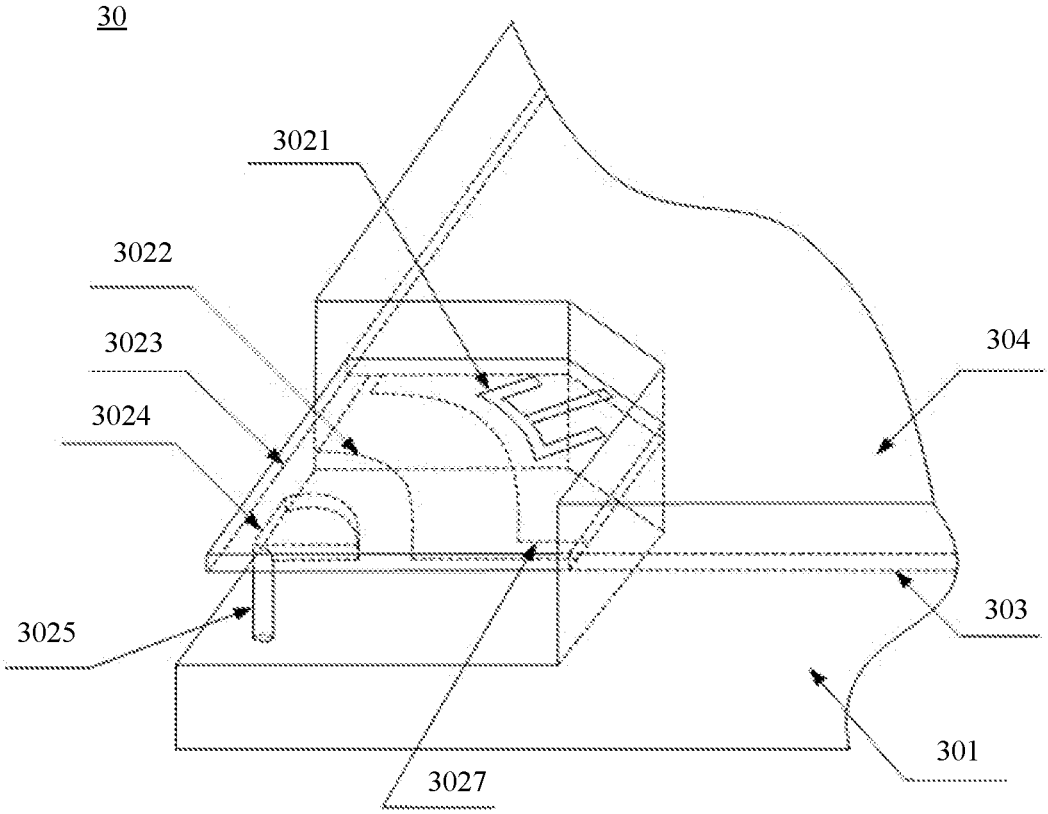
FIG. 11 is a schematic diagram of a partial structure of yet another wireless transceiver apparatus according to an embodiment of the present invention.

In actual application, relative positions of the radiation patch, the feeding structure, and the parasitic structure on the dielectric substrate may be determined according to a specific situation. Two of the radiation patch, the feeding structure, and the parasitic structure may be located on one side of the dielectric substrate, and one of the radiation patch, the feeding structure, and the parasitic structure may be located on the other side of the dielectric substrate; or the radiation patch, the feeding structure, and the parasitic structure are located on a same side of the dielectric substrate. As shown in FIG. 4-2, FIG. 6, or FIG. 7, the radiation patch 3022 and the feeding structure 3021 are located on one side of the dielectric substrate, and the parasitic structure 3024 is located on the other side of the dielectric substrate. As shown in FIG. 5 or FIG. 11, the radiation patch 3022 and the parasitic structure 3024 are located on one side of the dielectric substrate 3023, and the feeding structure 3021 is located on the other side of the dielectric substrate 3023. For example, the radiation patch and the parasitic structure are located on a lower surface of the dielectric substrate, and the feeding structure is located on an upper surface of the dielectric substrate.

Figure 12:
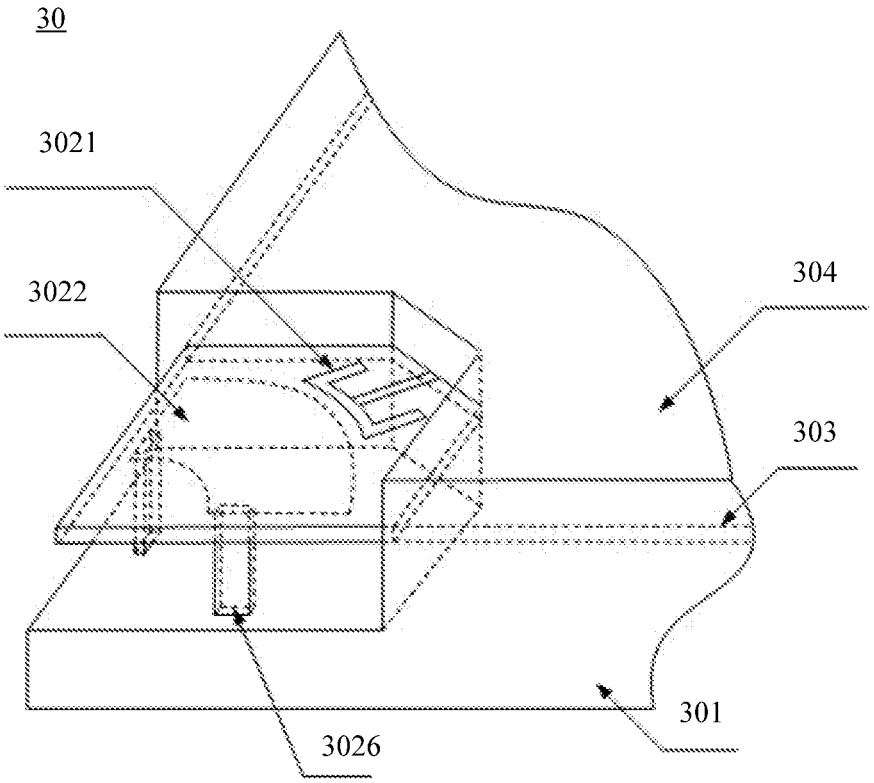
FIG. 12 is a schematic diagram of a partial structure of a wireless transceiver apparatus according to an embodiment of the present invention.

Certainly, when no parasitic structure is disposed on the wireless transceiver apparatus, relative positions of the radiation patch 3022 and the feeding structure 3021 on the dielectric substrate may be determined according to a specific situation. The radiation patch 3022 and the feeding structure 3021 may be respectively located on two sides of the dielectric substrate 3023, or the radiation patch 3022 and the feeding structure 3021 may be located on a same side of the dielectric substrate 3023. As shown in FIG. 3-2, the radiation patch 3022 and the feeding structure 3021 are located on a same side of the dielectric substrate 3023. As shown in FIG. 12, the radiation patch and the feeding structure are respectively located on two sides of the dielectric substrate.

In FIG. 12, the radiation patch 3022 is located on a lower surface of the dielectric substrate 3023. The antenna unit 302 may further include: a second ground pin 3026 disposed on at least one side of the radiation patch 3022. The second ground pin 3026 may be made of metal. One end of the second ground pin 3026 is connected to the radiation patch 3022, and the other end of the second ground pin 3026 is connected to the metal carrier 301. The second ground pin 3026 is perpendicular to a surface of the dielectric substrate 3023, and the radiation patch 3022 is grounded by using the metal carrier 301. For example, in FIG. 12, two second ground pins 3026 are disposed in the antenna unit 302. The two second ground pins 3026 are symmetrically disposed on two sides of the radiation patch 3022. Based on the second ground pin 3026, the radiation patch may be disposed parallel to a bottom surface of the groove, so that a capacitance is generated between the radiation patch and the bottom surface of the groove; and then the second ground pin is disposed, so that an inductance is generated between the radiation patch and the bottom surface of the groove, and then electromagnetic oscillation is excited. In addition, the second ground pin not only enables the radiation patch to be electrically connected to the metal carrier across a relatively short path, but also can support the dielectric substrate to avoid deformation of the dielectric substrate. A manufacturing technology of the second ground pin is relatively simple. In addition, two second ground pins 3026 are symmetrically disposed on two sides of the radiation patch 3022, so that a size of the antenna unit can be effectively reduced, and a bandwidth is extended.

As shown in any one of FIG. 4-1 to FIG. 7, or as shown in FIG. 11 or FIG. 12, the wireless transceiver apparatus 30 may further include a shielding cover 304. The shielding cover 304 is buckled on the dielectric substrate 303 of the metal carrier 301, and is configured to shield interference between a radio frequency circuit and an external environment and interference between the radio frequency circuit and an antenna unit. It should be noted that a shape of the shielding cover may be adaptively adjusted according to positions of grooves on the metal carrier. For example, when the grooves are located on four corners of the metal carrier, grooves that match the grooves are also disposed on four corners of the shielding cover, so that the grooves of the shielding cover and the metal carrier are connected, and the shielding cover and the metal carrier are effectively buckled.

Figure 13:
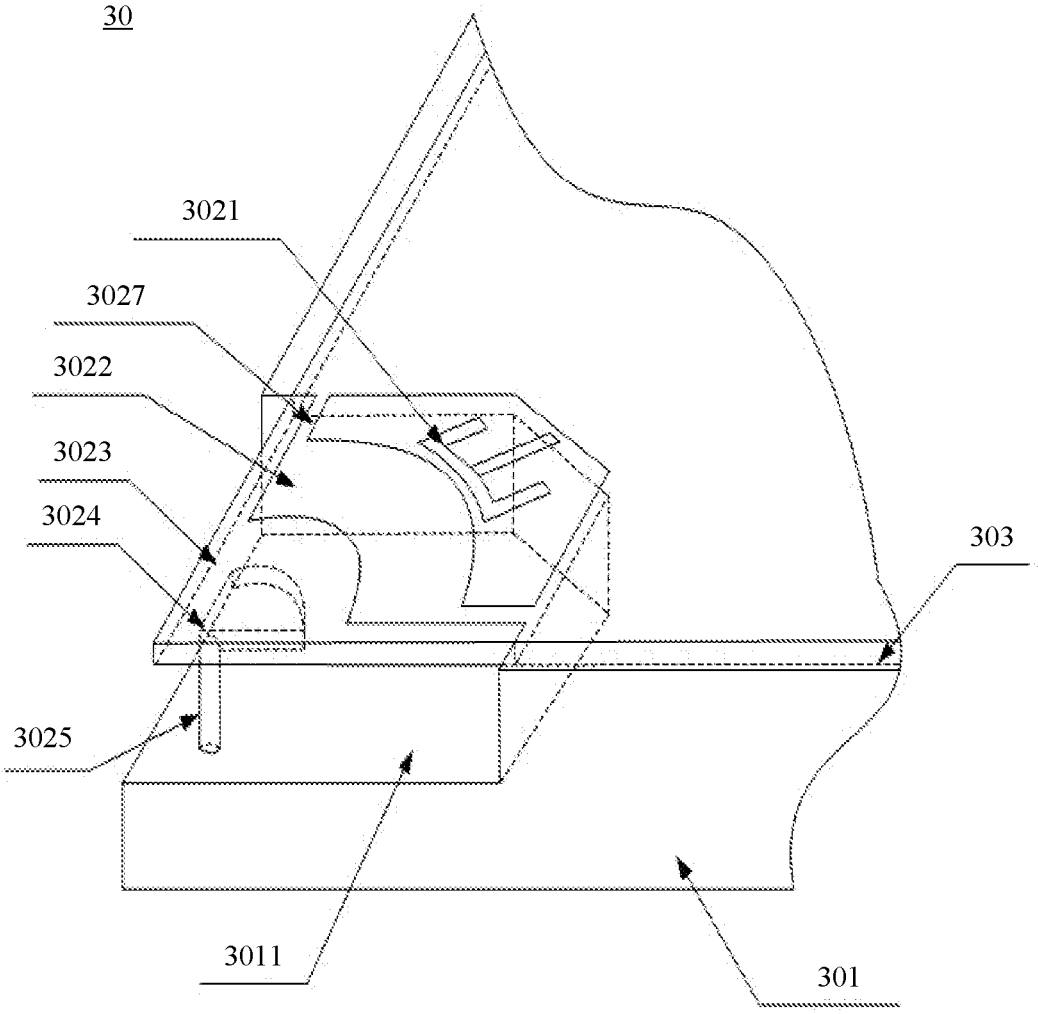
FIG. 13 is a schematic diagram of a partial structure of another wireless transceiver apparatus according to an embodiment of the present invention.

In actual application, alternatively, the wireless transceiver apparatus 30 may be shown in FIG. 13, and does not include the shielding cover. The dielectric substrate is directly buckled on the metal carrier. In actual application, the dielectric substrate may also be disposed inside the metal carrier, and FIG. 13 is used only as an example for description. Optionally, for a component that is inside the metal carrier and for which a shielding structure needs to be disposed, a small shielding cover may be buckled outside the component to avoid interference between the component and an external environment. As shown in FIG. 13, no shielding cover is disposed on the wireless transceiver apparatus 30, so that a total thickness of the wireless transceiver apparatus may be reduced, and correspondingly, a volume of the wireless transceiver apparatus is reduced.

It should be noted that, alternatively, the radiation patch 3022 may be grounded in another manner in addition to using the ground pin. Optionally, as shown in FIG. 4-1 or FIG. 4-2, the antenna unit 302 may further include a ground cable 3027. The ground cable 3027 is made of metal, one end of the ground cable 3027 is connected to the radiation patch 3022, and the other end of the ground cable 3027 is connected to a metal ground cable (not explicitly shown in the figure) of the dielectric substrate 3023, so that the radiation patch 3022 is grounded by using the metal ground cable (not explicitly shown in the figure). For an antenna unit on which the ground cable is disposed, a weak inductance may be generated between the radiation patch and a bottom surface of the groove, so that electromagnetic oscillation is generated between the radiation patch and the bottom surface of the groove. In this embodiment of the present invention, to ensure that a relatively strong inductance is generated between the radiation patch and the bottom surface of the groove, when the radiation patch is grounded by using the ground cable, a ground pin perpendicular to the bottom surface of the groove may be added below the radiation patch; or when the radiation patch is grounded by using the ground cable, a parasitic structure may be added, and a ground pin perpendicular to the bottom surface of the groove may be added below the parasitic structure. In this way, a relatively strong inductance is generated. In actual application, alternatively, the inductance may be increased in another manner. This is not limited in this embodiment of the present invention.

A quantity of ground cables 3027 in the antenna unit 302 may be determined according to an actual situation. For example, as shown in FIG. 6, the ground cable 3027 is disposed on a side of the radiation patch 3022, and the feeding structure 3021 is disposed on another side of the radiation patch.

For another example, as shown in FIG. 4-1, there are two ground cables 3027 in total. The two ground cables 3027 are symmetrically disposed on two sides of the radiation patch 3022, and are separately connected to the metal ground cable of the dielectric substrate 3023. The feeding structure 3021 is an axisymmetric structure, and a symmetry axis of the feeding structure 3021 is the same as a symmetry axis of the two ground cables 3027. In this way, antenna pattern roundness may be relatively easily controlled.

Further, as shown in any one of FIG. 3-1 to FIG. 7 or FIG. 11 to FIG. 13, an opening may exist on a side wall of the groove, that is, the side wall of the groove is non-closed. In FIG. 3-1 to FIG. 7, the groove is disposed on a corner of the metal carrier, and an opening of the two adjacent side walls of the groove. When the groove is disposed on a side of the metal carrier, an opening may exist on a side wall. In this way, effective feeding and energy radiation of the antenna unit can be ensured. In addition, a half-open groove can be easily processed, manufactured, and assembled.

Optionally, a heat sink fin may be further disposed on a bottom of the metal carrier. The heat sink fin is configured to dissipate heat for the metal carrier.

For the omnidirectional antenna unit in the wireless transceiver apparatus in any one of FIG. 3-1 to FIG. 7 or FIG. 11 to FIG. 13 in the present invention, a voltage standing wave ratio (VSWR) may be less than 2.5, and a standing wave bandwidth may be greater than 45%.

Figure 14:
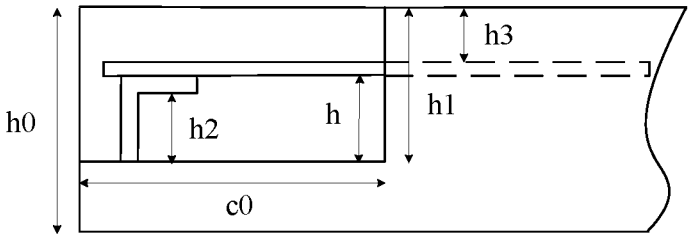
FIG. 14 is a left view of the wireless transceiver apparatus shown in FIG. 4-2.
Figure 15:
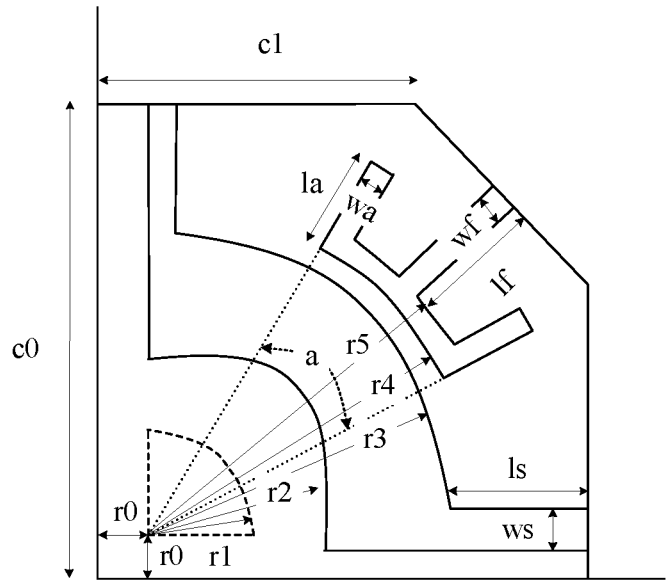
FIG. 15 is a top view of the wireless transceiver apparatus shown in FIG. 4-2.

For the wireless transceiver apparatus 30 shown in FIG. 4-2, a left view and a top view of the wireless transceiver apparatus 30 are respectively shown in FIG. 14 and FIG. 15. FIG. 14 and FIG. 15 show structure parameters of the wireless transceiver apparatus 30. As shown in FIG. 14, a thickness of the wireless transceiver apparatus 30 is h0, that is, a total thickness of the metal carrier 301, the dielectric substrate 3023 (or the dielectric substrate 303), and the shielding cover 304 that are sequentially superposed from bottom to top is h0. A depth of the groove 3011 is h1-h3, and h3 is a thickness of the shielding cover. A distance from a lower surface of the dielectric substrate 3023 to a bottom surface of the groove 3011 is h. A height of the first ground pin 3025 is h2. The dielectric substrate 303 and the groove 3011 have a same shape, and may have a same size or different sizes. Generally, a size of the dielectric substrate 303 is less than a size of the groove 3011. As shown in FIG. 15, a top view of the groove 3011 is a square that has a corner from which an isosceles right triangle is cut off. A side length of the square is c0, and a side length of the isosceles right triangle is c0-c1. Distances from a center of a sector (which may also be considered as a quarter of a circle) parasitic structure 3024 to two sides of the groove 3011 are both r0, a radius of the sector is r1, and a central angle corresponding to the sector is 90°. For a semi-annular (which may also be considered as a quarter of a ring) radiation patch 3022, an inner diameter is r2, an outer diameter is r3, and a central angle is 90°. A center of the radiation patch coincides with the center of the sector parasitic structure. The radiation patch 3022 is an E-shaped structure, and a first vertical strip structure of the radiation patch 3022 is a semi-annular structure. For the semi-annular structure, an inner diameter is r4, an outer diameter is r5, and a central angle is a. A first horizontal strip structure located on an external edge of the E-shaped structure has a length of la and a width of wa. A first horizontal strip structure located in the middle of the E-shaped structure has a length of lf and a width of wf. There are two ground cables 3027. The two ground cables 3027 are symmetrically disposed on two sides of the radiation patch 3022, and are separately connected to the metal ground cable of the dielectric substrate 3023. Each ground cable 3027 is a strip structure, and has a length of ws and a width of ls.

For example, values of structure parameters of the antenna unit in the wireless transceiver apparatus 30 shown in FIG. 4-2 are shown in Table 2. λl is a wavelength corresponding to a lowest operating frequency of the antenna unit in the wireless transceiver apparatus 30, and r0 (0.05104λl, 0.07656λl) represents that r0 is in a range of 0.05104λl to 0.07656×1.

TABLE 2

| Structure parameter | Value |
|---|---|
| H | 0.0593λl |
| h0 | 0.171λl |
| h1 | 0.120λl |
| h2 | 0.0483λl |
| c0 | 0.251λl |
| c1 | 0.145λl |
| r0 | (0.05104λl, 0.07656λl) |
| r1 | (0.05472λl, 0.08208λl) |
| r2 | (0.0848λl, 0.1776λl) |
| r3 | (0.1184λl, 0.1776λl) |
| r4 | (0.1216λl, 0.1824λl) |
| r5 | (0.1336λl, 0.2004λl) |
| wa | 0.0126λl |
| ws | 0.0105λl |
| wf | 0.0188λl |
| la | 0.0436λl |
| ls | 0.0391λl |
| lf | 0.0377λl |
| a | 25.7° |

Figure 16:
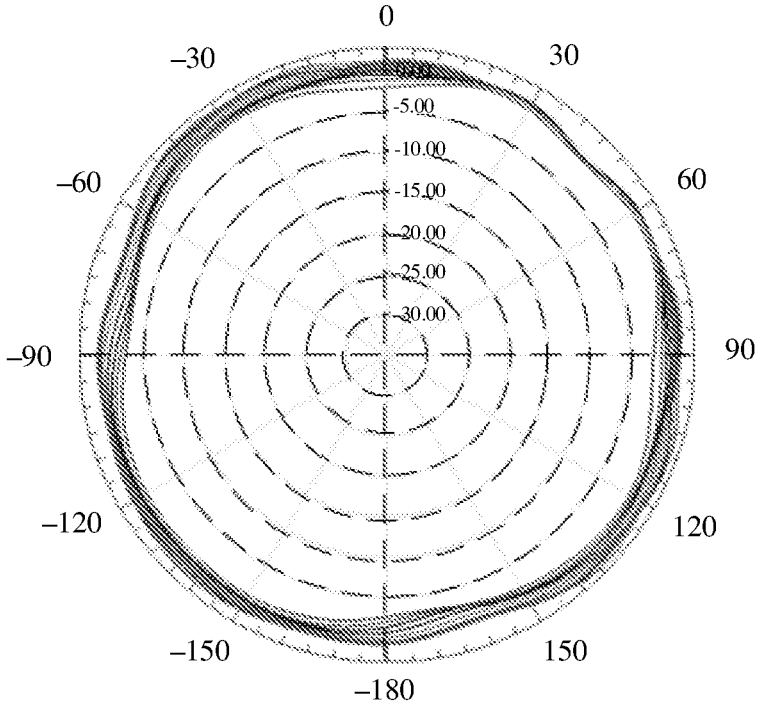
FIG. 16 is an emulation diagram of a directivity pattern of an antenna unit in the wireless transceiver apparatus in FIG. 4-2.

When the values of the structure parameters of the antenna unit in the wireless transceiver apparatus 30 in FIG. 4-2 are shown in Table 2, for an antenna unit designed according to the structure parameters in Table 2, an emulation diagram of a directivity pattern of the antenna unit obtained by means of emulation may be shown in FIG. 16. When Theta=80°, antenna pattern roundness corresponding to different frequencies in FIG. 16 is shown in Table 3. It can be learned from the emulation diagram shown in FIG. 16 and Table 3 that the antenna unit with this structure form in the wireless transceiver apparatus 30 shown in FIG. 4-2 has a lowest roundness of 3.3 dB in a frequency band range of 1.7 GHz to 2.7 GHz. The directivity pattern has a relatively low fluctuation, so that a relatively large coverage area can be provided, and a communications capability is improved.

TABLE 3

| Frequency (GHz) | Cross section roundness (dB) when Theta = 80° |
|---|---|
| 1.7 | 3.3 |
| 1.9 | 3.3 |
| 2.1 | 2.3 |
| 2.3 | 2.5 |
| 2.5 | 2.6 |
| 2.7 | 3.1 |

Figure 17:
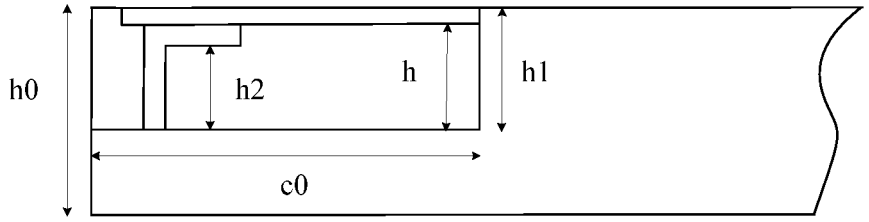
FIG. 17 is a left view of the wireless transceiver apparatus shown in FIG. 13.
Figure 18:
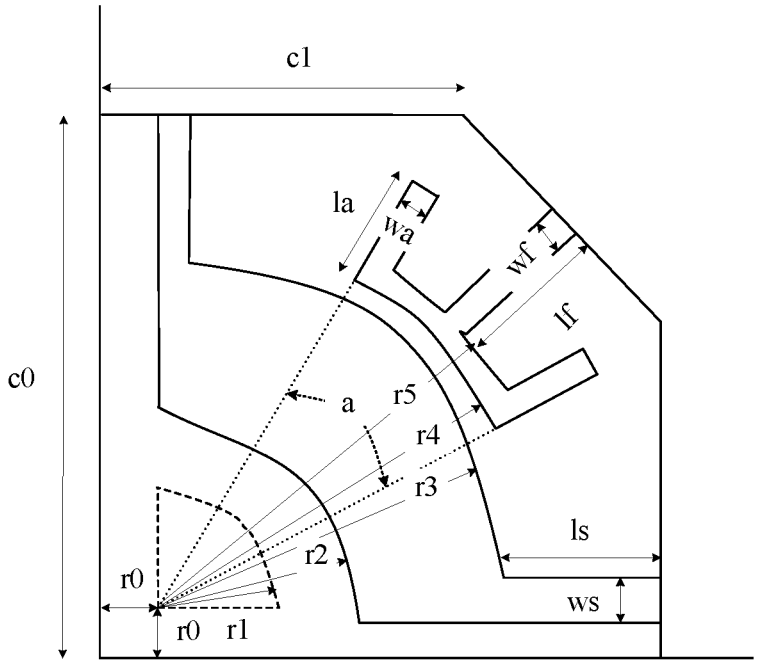
FIG. 18 is a top view of the wireless transceiver apparatus shown in FIG. 13.

For the wireless transceiver apparatus 30 shown in FIG. 13, a left view and a top view of the wireless transceiver apparatus 30 are respectively shown in FIG. 17 and FIG. 18. FIG. 17 and FIG. 18 show structure parameters of the wireless transceiver apparatus 30. As shown in FIG. 17, a thickness of the wireless transceiver apparatus 30 is h0, that is, a total thickness of the metal carrier 301 and the dielectric substrate 3023 (or the dielectric substrate 303) that are sequentially superposed from bottom to top is h0. A depth of the groove 3011 is h1. A distance from a lower surface of the dielectric substrate 3023 to a bottom surface of the groove 3011 is h. A height of the first ground pin 3025 is h2. As shown in FIG. 18, a top view of the groove 3011 (the dielectric substrate and the groove have a same shape) is a square that has a corner from which an isosceles right triangle is cut off. A side length of the square is c0, and a side length of the isosceles right triangle is c0-c1. Distances from a center of a sector (which may also be considered as a quarter of a circle) parasitic structure 3024 to two sides of the groove 3011 are both r0, a radius of the sector is r1, and a central angle is 90°. A center of the radiation patch coincides with the center of the sector parasitic structure. The radiation patch 3022 is an E-shaped structure, and a first vertical strip structure of the radiation patch 3022 is a semi-annular structure. For the semi-annular structure, an inner diameter is r4, an outer diameter is r5, and a central angle is a. A first horizontal strip structure located on an external edge of the E-shaped structure has a length of la and a width of wa. A first horizontal strip structure located in the middle of the E-shaped structure has a length of if and a width of wf. There are two ground cables 3027. The two ground cables 3027 are symmetrically disposed on two sides of the radiation patch 3022, and are separately connected to the metal ground cable of the dielectric substrate 3023. Each ground cable 3027 is a strip structure, and has a length of ws and a width of ls.

Values of structure parameters of the antenna unit in the wireless transceiver apparatus 30 shown in FIG. 13 are shown in Table 4. λl is a wavelength corresponding to a lowest operating frequency of the antenna unit in the wireless transceiver apparatus 30, and r0 (0.0328λl, 0.0492λl) represents that r0 is in a range of 0.0328λl to 0.0492λl.

TABLE 4

| Structure parameter | Value |
|---|---|
| H | 0.0593λl |
| h0 | 0.120λl |
| h2 | 0.0483λl |
| c0 | 0.274λl |
| c1 | 0.188λl |
| r0 | (0.0328λl, 0.0492λl) |
| r1 | (0.062λl, 0.093λl) |
| r2 | (0.096λl, 0.144λl) |
| r3 | (0.1248λl, 0.1872λl) |
| r4 | (0.1272λl, 0.1908λl) |
| r5 | (0.1376λl, 0.2064λl) |
| wa | 0.008λl |
| ws | 0.008λl |
| wf | 0.0148λl |
| la | 0.0444λl |
| ls | 0.0313λl |
| lf | 0.0319λl |
| a | 26.89° |

Figure 19:
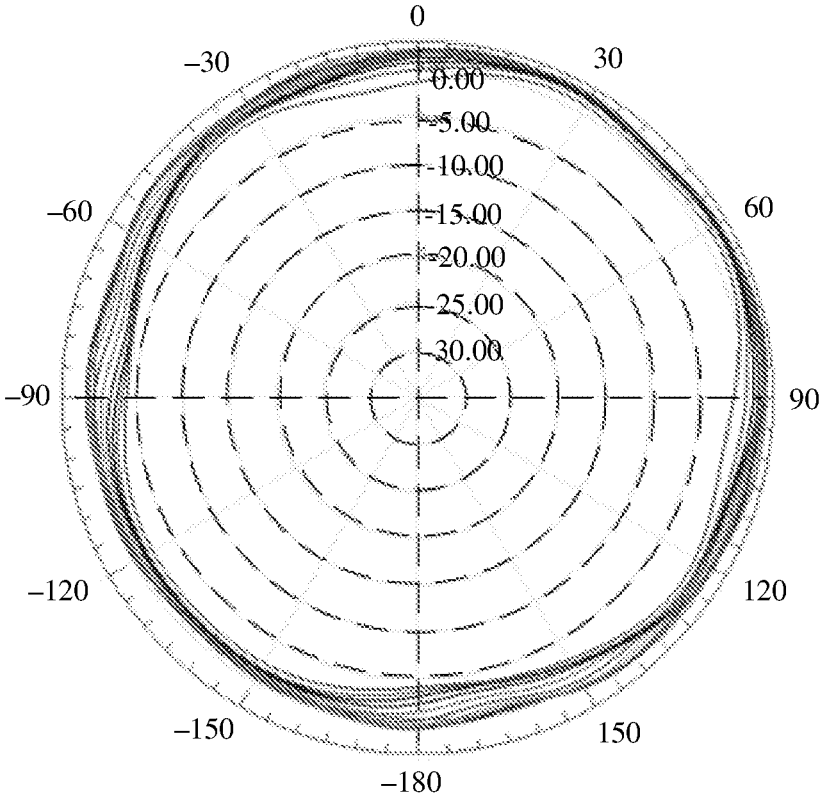
FIG. 19 is an emulation diagram of a directivity pattern of an antenna unit in the wireless transceiver apparatus in FIG. 13.

When the values of the structure parameters of the antenna unit in the wireless transceiver apparatus 30 in FIG. 13 are shown in Table 4, an emulation diagram of a directivity pattern of the antenna unit may be shown in FIG. 19. When Theta=80°, antenna pattern roundness corresponding to different frequencies in FIG. 19 is shown in Table 5. It can be learned from the emulation diagram shown in FIG. 19 and Table 5 that the antenna unit in the wireless transceiver apparatus 30 shown in FIG. 13 has a lowest roundness of 5.4 dB in a frequency band range of 1.7 GHz to 2.7 GHz. The directivity pattern has a relatively low fluctuation, so that a relatively large coverage area can be provided, and a communications capability is improved.

TABLE 5

| Frequency (GHz) | Cross section roundness (dB) when Theta = 80° |
|---|---|
| 1.7 | 5.1 |
| 1.9 | 5.4 |
| 2.1 | 4.4 |
| 2.3 | 3.2 |
| 2.5 | 3.4 |
| 2.7 | 3.2 |

For the wireless transceiver apparatus 30 shown in FIG. 11, a left view and a top view of the wireless transceiver apparatus 30 are respectively basically the same as the left view and the top view of the wireless transceiver apparatus 30 in FIG. 13, but the radiation patch 3022 cannot be directly seen from the top view of the wireless transceiver apparatus 30 in FIG. 11. For a left view and a top view of the wireless transceiver apparatus 30 shown in FIG. 11, refer to FIG. 17 and FIG. 18. As shown in FIG. 17, a thickness of the wireless transceiver apparatus 30 is h0, that is, a total thickness of the metal carrier 301 and the dielectric substrate 3023 (or the dielectric substrate 303) that are sequentially superposed from bottom to top is h0. A depth of the groove 3011 is h1. A distance from a lower surface of the dielectric substrate 3023 to a bottom surface of the groove 3011 is h. A height of the first ground pin 3025 is h2. As shown in FIG. 18, a top view of the groove 3011 (the dielectric substrate and the groove have a same shape) is a square that has a corner from which an isosceles right triangle is cut off. A side length of the square is c0, and a side length of the isosceles right triangle is c0-c1. Distances from a center of a sector (which may also be considered as a quarter of a circle) parasitic structure 3024 to two sides of the groove 3011 are both r0, a radius of the sector is r1, and a central angle is 90°. For a semi-annular (which may also be considered as a quarter of a ring) radiation patch 3022, an inner diameter is r2, an outer diameter is r3, and a central angle is 90°. A center of the radiation patch coincides with the center of the sector parasitic structure. The radiation patch 3022 is an E-shaped structure, and a first vertical strip structure of the radiation patch 3022 is a semi-annular structure. For the semi-annular structure, an inner diameter is r4, an outer diameter is r5, and a central angle is a. A first horizontal strip structure located on an external edge of the E-shaped structure has a length of la and a width of wa. A first horizontal strip structure located in the middle of the E-shaped structure has a length of lf and a width of wf. There are two ground cables 3027. The two ground cables 3027 are symmetrically disposed on two sides of the radiation patch 3022, and are separately connected to the metal ground cable of the dielectric substrate 3023. Each ground cable 3027 is a strip structure, and has a length of ws and a width of ls.

Values of structure parameters of the antenna unit in the wireless transceiver apparatus 30 shown in FIG. 11 are shown in Table 6. λl is a wavelength corresponding to a lowest operating frequency of the antenna unit in the wireless transceiver apparatus 30, and r0 (0.05104λl, 0.07656λl) represents that r0 is in a range of 0.05104λl to 0.07656λl.

TABLE 6

| Structure parameter | Value |
|---|---|
| h | 0.0593λl |
| h0 | 0.171λl |
| h1 | 0.120λl |
| h2 | 0.0483λl |

TABLE 6-continued

| Structure parameter | Value |
|---|---|
| c0 | 0.251λl |
| c1 | 0.145λl |
| r0 | (0.05104λl, 0.07656λl) |
| r1 | (0.05576λl, 0.08364λl) |
| r2 | (0.0864λl, 0.1296λl) |
| r3 | (0.1176λl, 0.1764λl) |
| r4 | (0.12λl, 0.18λl) |
| r5 | (0.1304λl, 0.1956λl) |
| wa | 0.0122λl |
| ws | 0.009λl |
| wf | 0.02λl |
| la | 0.045λl |
| ls | 0.0407λl |
| lf | 0.0414λl |
| a | 28.56deg |

Figure 20:
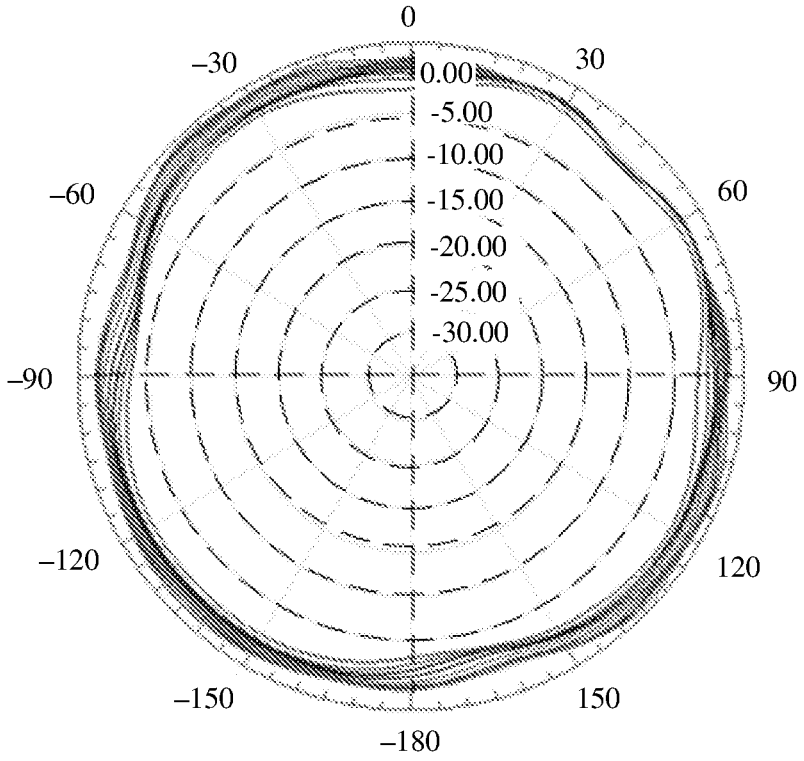
FIG. 20 is an emulation diagram of a directivity pattern of an antenna unit in the wireless transceiver apparatus in FIG. 11.

When the values of the structure parameters of the antenna unit in the wireless transceiver apparatus 30 in FIG. 11 are shown in Table 6, an emulation diagram of a directivity pattern of the antenna unit may be shown in FIG. 20. When Theta=80°, antenna pattern roundness corresponding to different frequencies in FIG. 20 is shown in Table 7. It can be learned from the emulation diagram shown in FIG. 20 and Table 7 that the antenna unit in the wireless transceiver apparatus 30 shown in FIG. 11 has a lowest roundness of 3.6 dB in a frequency band range of 1.7 GHz to 2.7 GHz. The directivity pattern has a relatively low fluctuation, so that a relatively large coverage area can be provided, and a communications capability is improved.

TABLE 7

| Frequency (GHz) | Cross section roundness (dB) when Theta = 80° |
|---|---|
| 1.7 | 3.4 |
| 1.9 | 3.6 |
| 2.1 | 2.5 |
| 2.3 | 2.6 |
| 2.5 | 2.9 |
| 2.7 | 3.6 |

Figure 21:
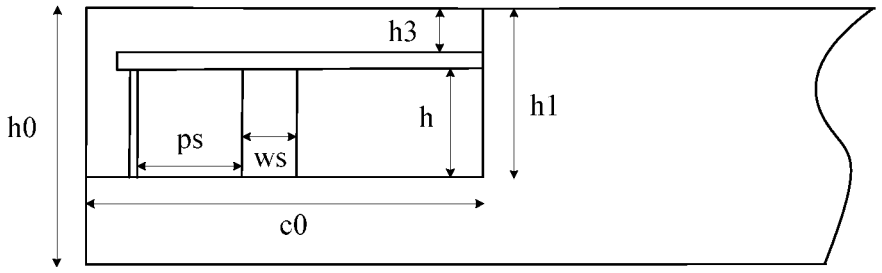
FIG. 21 is a left view of the wireless transceiver apparatus shown in FIG. 12.
Figure 22:
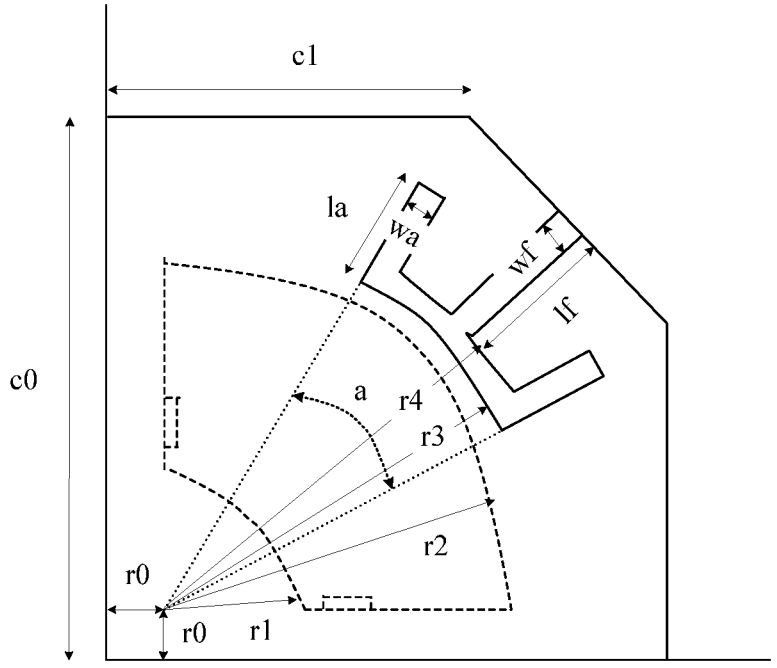
FIG. 22 is a top view of the wireless transceiver apparatus shown in FIG. 12.

For the wireless transceiver apparatus 30 shown in FIG. 12, a left view and a top view of the wireless transceiver apparatus 30 are respectively shown in FIG. 21 and FIG. 22. FIG. 21 and FIG. 22 show structure parameters of the antenna unit in the wireless transceiver apparatus 30. As shown in FIG. 21, a thickness of the wireless transceiver apparatus 30 is h0, that is, a total thickness of the metal carrier 301 and the dielectric substrate 3023 (or the dielectric substrate 303) that are sequentially superposed from bottom to top is h0. A depth of the groove 3011 is h1-h3, and h3 is a thickness of the shielding cover. A distance from a lower surface of the dielectric substrate 3023 to a bottom surface of the groove 3011 is equal to a height of a second ground pin 3026, and is h. A projection distance from the second ground pin 3026 to the center of the radiation patch 3022 is ps. A width of each second ground pin 3026 is ws. As shown in FIG. 22, a top view of the groove 3011 (the dielectric substrate and the groove have a same shape) is a square that has a corner from which an isosceles right triangle is cut off. A side length of the square is c0, and a side length of the isosceles right triangle is c0-c1. For a semi-annular (which may also be considered as a quarter of a ring) radiation patch 3022, an inner diameter is r1, an outer diameter is r2, and a central angle is 90°. Distances from a center of the semi-annular (which may also be considered as a quarter of a ring) radiation patch 3022 to two sides of the groove 3011 are both r0. The radiation patch 3022 is an E-shaped structure, and a first vertical strip structure of the radiation patch 3022 is a semi-annular structure. For the semi-annular structure, an inner diameter is r4, an outer diameter is r5, and a central angle is a. A first horizontal strip structure located on an external edge of the E-shaped structure has a length of la and a width of wa. A first horizontal strip structure located in the middle of the E-shaped structure has a length of if and a width of wf.

Values of structure parameters of the antenna unit in the wireless transceiver apparatus 30 shown in FIG. 12 are shown in Table 8. λl is a wavelength corresponding to a lowest operating frequency of the antenna unit in the wireless transceiver apparatus 30, and r0 (0.03736λl, 0.05604λl) represents that r0 is in a range of 0.03736 λl to 0.05604λl

TABLE 8

| Structure parameter | Value |
|---|---|
| h | 0.0593λl |
| h0 | 0.171λl |
| h1 | 0.120λl |
| c0 | 0.262λl |
| c1 | 0.177λl |
| r0 | (0.03736λl, 0.05604λl) |
| r1 | (0.03688λl, 0.05532λl) |
| r2 | (0.1168λl, 0.1752λl) |
| r3 | (0.1256λl, 0.1884λl) |
| r4 | (0.14λl, 0.12λl) |
| wa | 0.0134λl |
| ws | 0.0378λl |
| wf | 0.0313λl |
| la | 0.0509λl |
| ps | 0.0413λl |
| lf | 0.0704λl |
| a | 23.4deg |

Figure 23:
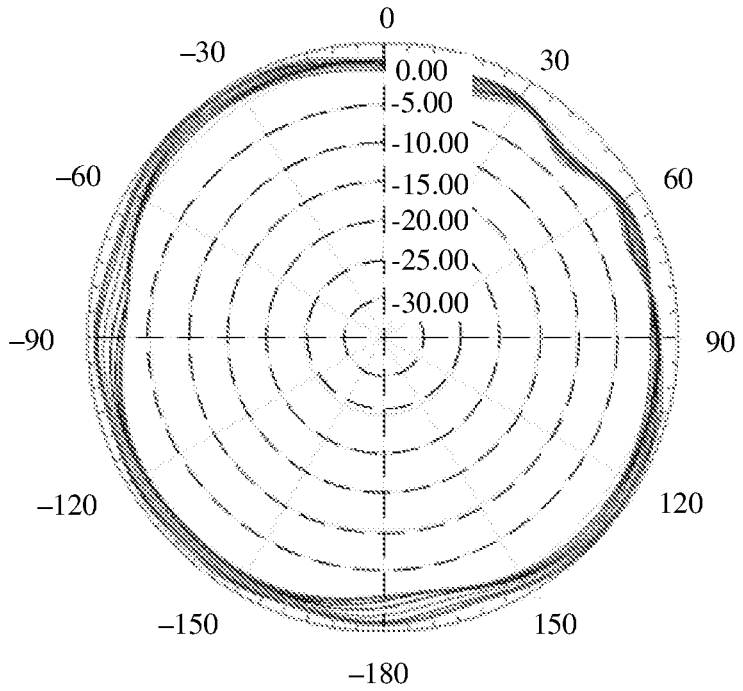
FIG. 23 is an emulation diagram of a directivity pattern of an antenna unit in the wireless transceiver apparatus in FIG. 12.

When the values of the structure parameters of the antenna unit in the wireless transceiver apparatus 30 in FIG. 12 are shown in Table 8, an emulation diagram of a directivity pattern of the antenna unit may be shown in FIG. 23. When Theta=80°, antenna pattern roundness corresponding to different frequencies in FIG. 23 is shown in Table 9. It can be learned from the emulation diagram shown in FIG. 23 and Table 9 that the antenna unit in the wireless transceiver apparatus 30 shown in FIG. 13 has a lowest roundness of 5.8 dB in a frequency band range of 1.7 GHz to 2.7 GHz. The directivity pattern has a relatively low fluctuation, so that a relatively large coverage area can be provided, and a communications capability is improved.

TABLE 9

| Frequency (GHz) | Cross section roundness (dB) when Theta = 80° |
|---|---|
| 1.7 | 2.6 |
| 1.9 | 3.1 |
| 2.1 | 4.0 |
| 2.3 | 4.1 |
| 2.5 | 5.1 |
| 2.7 | 5.8 |

Figure 24:
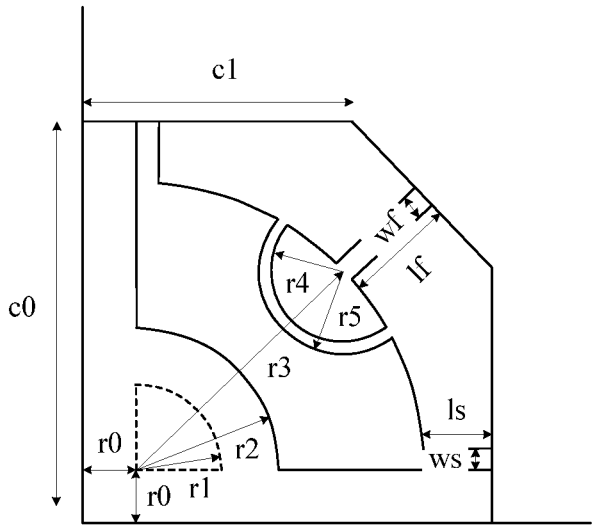
FIG. 24 is a top view of a wireless transceiver apparatus shown in FIG. 7.

For the wireless transceiver apparatus 30 shown in FIG. 7, a left view of the wireless transceiver apparatus 30 is the same as that shown in FIG. 17. For a top view of the wireless transceiver apparatus 30, refer to FIG. 24. As shown in FIG. 17, a thickness of the wireless transceiver apparatus 30 is h0, that is, a total thickness of the metal carrier 301 and the dielectric substrate 3023 (or the dielectric substrate 303) that are sequentially superposed from bottom to top is h0. A depth of the groove 3011 is h1. A distance from a lower surface of the dielectric substrate 3023 to a bottom surface of the groove 3011 is h. A height of the first ground pin 3025 is h2. As shown in FIG. 24, a top view of the groove 3011 (the dielectric substrate and the groove have a same shape) is a square that has a corner from which an isosceles right triangle is cut off. A side length of the square is c0, and a side length of the isosceles right triangle is c0-c1. Distances from a center of a sector (which may also be considered as a quarter of a circle) parasitic structure 3024 to two sides of the groove 3011 are both r0, a radius of the sector is r1, and a central angle is 90°. For a semi-annular (which may also be considered as a quarter of a ring) radiation patch 3022, an inner diameter is r2, an outer diameter is r3, and a central angle is 90°. An arc-shaped opening is disposed on a side that is of the radiation patch 3022 and that is close to the feeding structure 3021, and a radius of the arc-shaped opening is r5. A center of the radiation patch coincides with the center of the sector parasitic structure. The feeding structure 3021 is an integrated structure formed by an arc-shaped structure 30211 and a strip structure 30212. The strip structure has a length of wf and a width of lf. The arc-shaped structure 30211 has a radius r4, and is concentric with the arc-shaped opening. There are two ground cables 3027. The two ground cables 3027 are symmetrically disposed on two sides of the radiation patch 3022, and are separately connected to the metal ground cable of the dielectric substrate 3023. Each ground cable 3027 is a strip structure, and has a length of ws and a width of ls.

Values of structure parameters of the antenna unit in the wireless transceiver apparatus 30 shown in FIG. 7 are shown in Table 10. λl is a wavelength corresponding to a lowest operating frequency of the antenna unit in the wireless transceiver apparatus 30, and r0 (0.0456λl, 0.0648λl) represents that r0 is in a range of 0.0456λl to 0.0648λl.

TABLE 10

| Structure parameter | Value |
|---|---|
| h | 0.0593λl |
| h0 | 0.171λl |
| h1 | 0.120λl |
| h2 | 0.0483λl |
| c0 | 0.257λl |
| c1 | 0.171λl |
| r0 | (0.0456λl, 0.0648λl) |
| r1 | (0.05424λl, 0.08136λl) |
| r2 | (0.0896λl, 0.1344λl) |
| r3 | (0.1424λl, 0.2136λl) |
| r4 | (0.03128λl, 0.04692λl) |
| r5 | (0.0456λl, 0.0684λl) |
| Wf | 0.0145λl |
| Ws | 0.0031λl |
| Lf | 0.0431λl |
| Ls | 0.0208λl |

Figure 25:
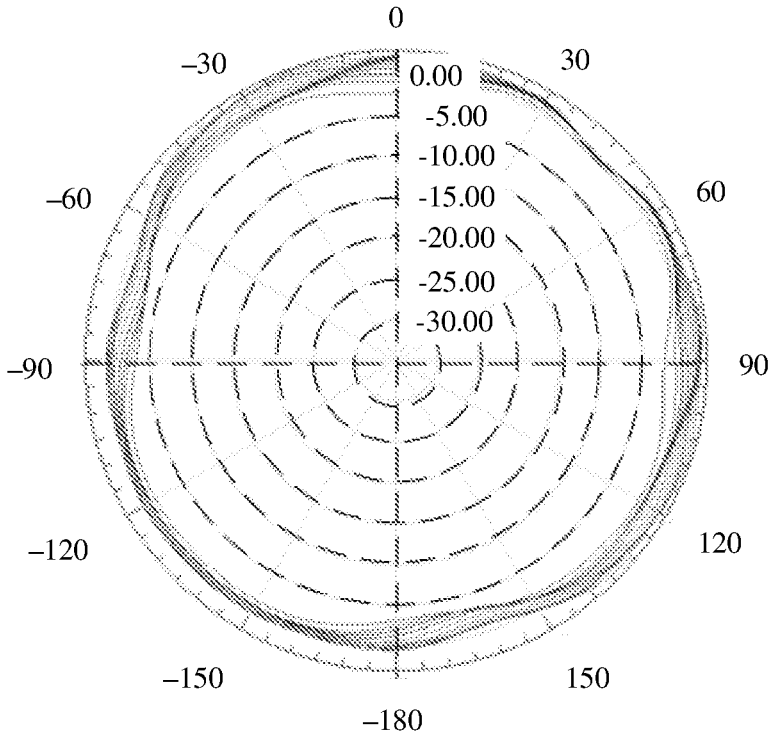
FIG. 25 is an emulation diagram of a directivity pattern of an antenna unit in the wireless transceiver apparatus in FIG. 7.

When the values of the structure parameters of the antenna unit in the wireless transceiver apparatus 30 in FIG. 7 are shown in Table 10, an emulation diagram of a directivity pattern of the antenna unit may be shown in FIG. 25. When Theta=80°, antenna pattern roundness corresponding to different frequencies in FIG. 25 is shown in Table 11. It can be learned from the emulation diagram shown in FIG. 25 and Table 11 that the antenna unit in the wireless transceiver apparatus 30 shown in FIG. 7 has a lowest roundness of 4.6 dB in a frequency band range of 1.7 GHz to 2.7 GHz. The directivity pattern has a relatively low fluctuation, so that a relatively large coverage area can be provided, and a communications capability is improved.

TABLE 11

| Frequency (GHz) | Cross section roundness (dB) when Theta = 80° |
|---|---|
| 1.7 | 4.1 |
| 1.9 | 4.6 |
| 2.1 | 3.7 |
| 2.3 | 3.2 |
| 2.5 | 3.4 |
| 2.7 | 3.6 |

Figure 26:
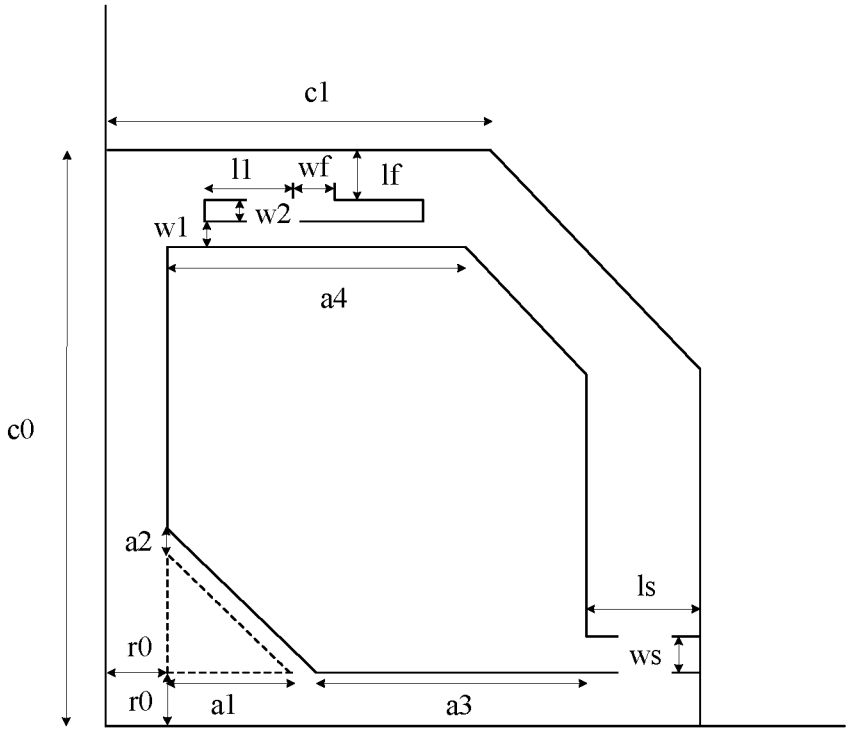
FIG. 26 is a top view of the wireless transceiver apparatus shown in FIG. 6.

For the wireless transceiver apparatus 30 shown in FIG. 6, a left view of the wireless transceiver apparatus 30 is the same as that shown in FIG. 17. For a top view of the wireless transceiver apparatus 30, refer to FIG. 26. As shown in FIG. 17, a thickness of the wireless transceiver apparatus 30 is h0, that is, a total thickness of the metal carrier 301 and the dielectric substrate 3023 (or the dielectric substrate 303) that are sequentially superposed from bottom to top is h0. A depth of the groove 3011 is h1. A distance from a lower surface of the dielectric substrate 3023 to a bottom surface of the groove 3011 is h. A height of the first ground pin 3025 is h2. As shown in FIG. 26, a top view of the groove 3011 (the dielectric substrate and the groove have a same shape) is a square that has a corner from which an isosceles right triangle is cut off. A side length of the square is c0, and a side length of the isosceles right triangle is c0-c1. Distances from a vertex of an isosceles right triangle parasitic structure 3024 to two sides of the groove 3011 are both r0, and a side length is a1. A top view of the radiation patch 3022 is a square that has two corners from which isosceles right triangles are respectively cut off. The two corners are respectively a corner that is close to the parasitic structure 3024 and a corner that is close to an end, with a corner cut off, of the groove. A side that is of the radiation patch 3022 and that is close to the parasitic structure 3024 is parallel to a bottom of the parasitic structure 3024. The remaining sides of the radiation patch 3022 are parallel to corresponding sides in the top view of the groove 3011. A side length of one side of the cut isosceles right triangle is a3, and a side length of another side of the cut isosceles right triangle is a4. The feeding structure 3021 is a T-shaped structure, and a length of a second vertical strip structure of the feeding structure 3021 is w2. A long side is parallel to a side that is of the radiation patch and that has a width of a4, and a distance between each other is w1. A second horizontal strip structure of the feeding structure 3021 has a length of lf and a width of wf. There is one ground cable 3027, and the ground cable 3027 and the feeding structure 3021 are located on different sides of the radiation patch 3022. The ground cable 3027 is connected to the metal ground cable of the dielectric substrate 3023. The ground cable 3027 is a strip structure, and has a length of ws and a width of ls.

Values of structure parameters of the antenna unit in the wireless transceiver apparatus 30 shown in FIG. 6 are shown in Table 12. λl is a wavelength corresponding to a lowest operating frequency of the antenna unit in the wireless transceiver apparatus 30, and r0 (0.0644λl, 0.0966λl) represents that r0 is in a range of 0.0644λl to 0.0966λl.

TABLE 12

| Structure parameter | Value |
|---|---|
| h | 0.0793λl |
| h0 | 0.181λl |
| h1 | 0.13λl |
| h2 | 0.0593λl |

TABLE 12-continued

| Structure parameter | Value |
|---|---|
| c0 | 0.3λl |
| c1 | 0.215λl |
| r0 | (0.0644λl, 0.0966λl) |
| a1 | 0.0476λl |
| a2 | 0.0309λl |
| a3 | 0.0794λl |
| a4 | 0.138λl |
| w1 | 0.0007λl |
| w2 | 0.0085λl |
| Wf | 0.0226λl |
| Ws | 0.0237λl |
| l1 | 0.0397λl |
| Lf | 0.0475λl |
| Ls | 0.0567λl |

Figure 27:
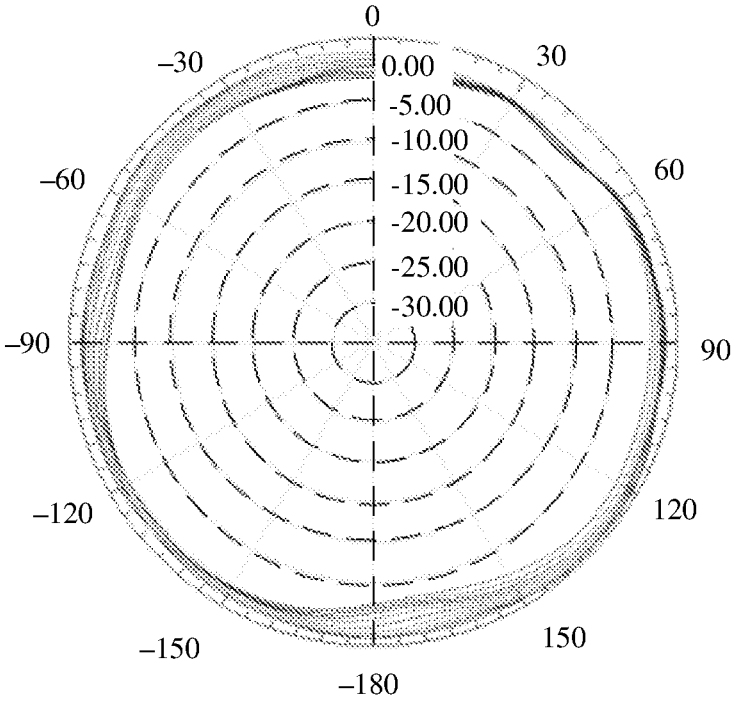
FIG. 27 is an emulation diagram of a directivity pattern of an antenna unit in the wireless transceiver apparatus in FIG. 6.

When the values of the structure parameters of the antenna unit in the wireless transceiver apparatus 30 in FIG. 6 are shown in Table 12, an emulation diagram of a directivity pattern of the antenna unit may be shown in FIG. 27. When Theta=80°, antenna pattern roundness corresponding to different frequencies in FIG. 27 is shown in Table 13. It can be learned from the emulation diagram shown in FIG. 27 and Table 13 that the antenna unit in the wireless transceiver apparatus 30 shown in FIG. 6 has a lowest roundness of 4.4 dB in a frequency band range of 1.7 GHz to 2.7 GHz. The directivity pattern has a relatively low fluctuation, so that a relatively large coverage area can be provided, and a communications capability is improved.

TABLE 13

| Frequency (GHz) | Cross section roundness (dB) when Theta = 80° |
|---|---|
| 1.7 | 3.2 |
| 1.9 | 3.5 |
| 2.1 | 3.9 |
| 2.3 | 4.3 |
| 2.5 | 4.4 |
| 2.7 | 4.4 |

Optionally, alternatively, the antenna unit 30 in the groove 3011 may be shown in FIG. 3-1 or FIG. 3-2. In FIG. 3-2, the feeding structure 3021 is formed by two feeding sub-structures. A part is a first feeding sub-structure 3021*a* that is perpendicular to a bottom surface of the groove 3011 and that is configured to be connected to a feed on the metal carrier, and the other part is a second feeding sub-structure 3021*b* parallel to the bottom surface of the groove 3011. In FIG. 3-2, an example in which the second feeding sub-structure 3021*b* is printed on an upper surface of the dielectric substrate 3023 is used for description. The radiation patch 3022 is also printed on the upper surface of the dielectric substrate 3023. A feed signal (which may also be considered as energy) is fed from the feeding structure 3021, and is coupled to the radiation patch 3022 in a coupling manner by using a slot. In addition, second ground pins 3026 are disposed on two sides of the radiation patch 3022. The radiation patch 3022 is connected to the metal carrier 301 by using the second ground pins 3026. An overall structure of the antenna unit is relatively independent of the metal carrier. Sizes of parts are adjusted, so that the antenna unit can obtain a standing wave bandwidth greater than 45% (VSWR<2.5). In addition, in this frequency band range, a directivity pattern of the antenna unit may have relatively high roundness.

Figure 28:
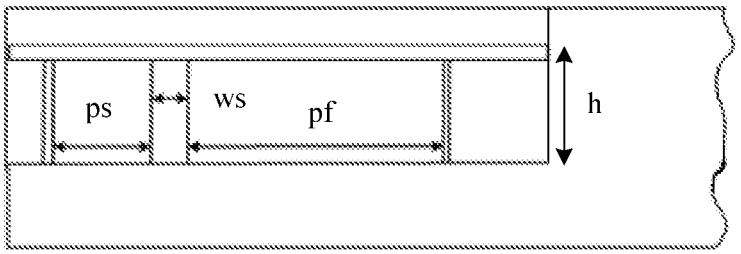
FIG. 28 is a left view of the wireless transceiver apparatus shown in FIG. 3-2.
Figure 29:
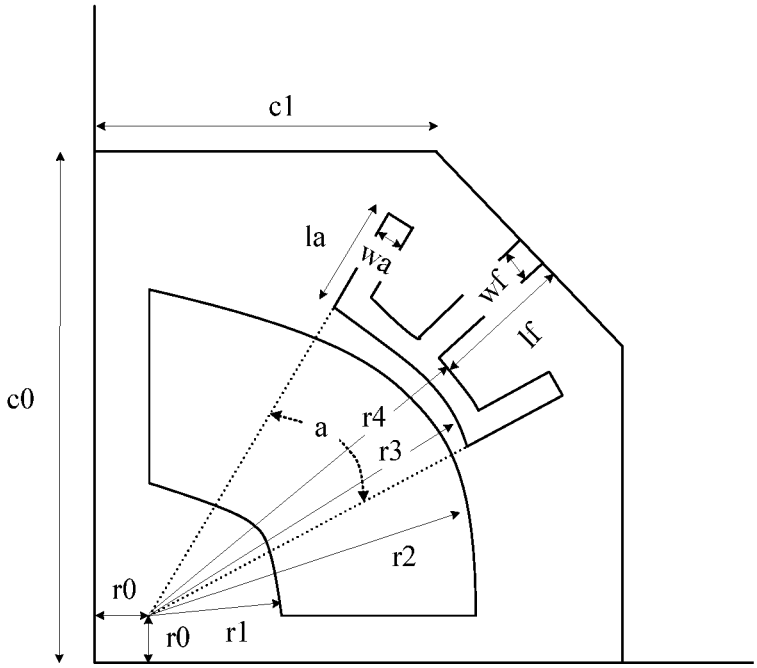
FIG. 29 is a top view of the wireless transceiver apparatus shown in FIG. 3-2.

For the wireless transceiver apparatus 30 shown in FIG. 3-2, a left view and a top view of the wireless transceiver apparatus 30 are respectively shown in FIG. 28 and FIG. 29. FIG. 28 and FIG. 29 show structure parameters of the antenna unit in the wireless transceiver apparatus 30. As shown in FIG. 28, a distance from an upper surface of the dielectric substrate 3023 to a bottom surface of the groove 3011 is h. A projection distance from the second ground pin 3026 to the center of the radiation patch 3022 is ps. A width of each second ground pin 3026 is ws. A distance from the second ground pin 3026 to the second feeding sub-structure 3021*b* is pf. As shown in FIG. 29, a top view of the groove 3011 (the dielectric substrate and the groove have a same shape) is a square that has a corner from which an isosceles right triangle is cut off. A side length of the square is c0, and a side length of the isosceles right triangle is c0-c1. For a semi-annular (which may also be considered as a quarter of a ring) radiation patch 3022, an inner diameter is r1, an outer diameter is r2, and a central angle is 90°. Distances from a center of the semi-annular (which may also be considered as a quarter of a ring) radiation patch 3022 to two sides of the groove 3011 are both r0. The radiation patch 3022 is an E-shaped structure, and a first vertical strip structure of the radiation patch 3022 is a semi-annular structure. For the semi-annular structure, an inner diameter is r4, an outer diameter is r5, and a central angle is a. A first horizontal strip structure located on an external edge of the E-shaped structure has a length of la and a width of wa. A first horizontal strip structure located in the middle of the E-shaped structure has a length of lf and a width of wf.

Values of structure parameters of the antenna unit in the wireless transceiver apparatus 30 shown in FIG. 3-2 are shown in Table 14. λl is a wavelength corresponding to a lowest operating frequency of the antenna unit in the wireless transceiver apparatus 30, and r1 (0.073λl, 0.1001) represents that r1 is in a range of 0.073λl to 0.1001.

TABLE 14

| Structure parameter | Value |
|---|---|
| h | 0.057λl |
| c0 | 0.217λl |
| c1 | 0.162λl |
| r0 | 0.0171λl |
| r1 | 0.073-0.109λl |
| r2 | 0.127-0.191λl |
| r3 | 0.141-0.211λl |
| r4 | 0.15-0.226λl |
| Pf | 0.0285λl |
| Wa | 0.0132λl |
| Ws | 0.0227λl |
| Wf | 0.0160λI |
| La | 0.0456λl |
| Ps | 0.0413λl |
| Lf | 0.0233λl |
| A | 15.3deg |

It should be noted that the structures of the foregoing wireless transceiver apparatus 30 in the embodiments of the present invention are used as examples for description. In actual application, components in the wireless transceiver apparatus 30 in FIG. 3-1 to FIG. 7 or FIG. 11 to FIG. 13 may be mutually referenced, combined, or replaced. For example, for a specific shape of a second feeding sub-structure 3021*b* in FIG. 3-1 and FIG. 3-2, refer to FIG. 4-1 to FIG. 7, and the second feeding sub-structure 3021*b* may be a T-shaped structure, an E-shaped structure, or an integrated structure formed by an arc-shaped structure and a strip structure. A difference is that the second feeding sub-structure 3021*b* may be connected to a feed by using a first feeding sub-structure 3021*a*. Any modification, equivalent replacement, and improvement made without departing from the spirit and principle of the present invention shall fall within the protection scope of the present invention. Details are not described in the present invention.

It should be noted that the sizes of the wireless transceiver apparatus provided in the embodiments of the present invention are used only as examples for description, and are mainly used to ensure that an antenna unit obtains a standing wave bandwidth greater than 45% (VSWR<2.5). In actual application, the size of the wireless transceiver apparatus may be adjusted according to a specific scenario. This is not limited in the embodiments of the present invention.

The wireless transceiver apparatus provided in the embodiments of the present invention has a simple structure, and can be easily assembled. A radiation patch, a feeding structure, a ground cable, and the like may be integrated on a dielectric substrate, and then is installed on a groove of a metal carrier. A shielding cover may be buckled on the metal carrier after the dielectric substrate is installed, or may be buckled on the metal carrier before the dielectric substrate is installed. A ground pin may be disposed after the dielectric substrate is installed. Because the radiation patch, the feeding structure, the ground cable, and the like may be integrated on the dielectric substrate, and are not a separately formed three-dimensional structure, a structure is simple, thereby facilitating assembly. If the wireless transceiver apparatus includes a shielding cover, the shielding cover may be buckled on the metal carrier after the dielectric substrate is installed. A ground pin may be disposed after the dielectric substrate is installed. Because the radiation patch, the feeding structure, the ground cable, and the like may be integrated on the dielectric substrate, and are not a separately formed three-dimensional structure, a structure is simple, thereby facilitating assembly.

It should be noted that, in the wireless transceiver apparatus provided in the foregoing embodiments of the present invention, the antenna unit may include a dielectric substrate, or may not include a dielectric substrate. The dielectric substrate is configured to bear the radiation patch and the feeding structure, and a shape of the dielectric substrate may be the same as or different from that of a groove. In the figure, that a shape of the dielectric substrate is the same as a shape of the groove, and an area of the dielectric substrate is less than an area of the groove is used as an example. When the antenna unit includes the dielectric substrate, electromagnetic oscillation may be generated between the radiation patch and a bottom surface of the groove by using the dielectric substrate. When the antenna unit does not include the dielectric substrate, electromagnetic oscillation may be generated between the radiation patch and a bottom surface of the groove in another manner. For example, as shown in FIG. 3-1, the wireless transceiver apparatus may further include a second ground pin 3026 disposed on at least one side of the radiation patch. One end of the second ground pin 3026 is connected to the radiation patch 3022, and the other end of the second ground pin is connected to the metal carrier 301. The second ground pin 3026 is perpendicular to a bottom surface of the groove 3011, and the radiation patch 3022 is grounded by using the metal carrier 301. The radiation patch 3022 may be supported by the second ground pin 3026, and the second feeding sub-structure 3021*b* may be supported by the first feeding sub-structure 3021*a*, so as to ensure that electromagnetic oscillation is generated between the radiation patch 3022 and the bottom surface of the groove. Optionally, the radiation patch and/or the feeding structure may be supported by a plastic structure, so that electromagnetic oscillation is generated between the radiation patch 3022 and a surface on which the antenna unit is disposed. A structure of the wireless transceiver apparatus in another embodiment may be adaptively modified with reference to FIG. 3-1. This is not limited in the embodiments of the present invention. Likewise, when the antenna unit includes the dielectric substrate, electromagnetic oscillation may be generated between a parasitic structure and a bottom surface of the groove by using the dielectric substrate. When the antenna unit does not include the dielectric substrate, electromagnetic oscillation may be generated between a parasitic structure and a bottom surface of the groove in another manner. For example, a ground pin that supports the parasitic structure is disposed or a plastic structure that supports the parasitic structure is used. Details are not described in the embodiments of the present invention again.

According to the wireless transceiver apparatus provided in this embodiment of the present invention, an antenna unit is disposed in a groove of a metal carrier, so that a total thickness of the wireless transceiver apparatus is reduced, and a total volume is reduced, thereby reducing space occupied by the wireless transceiver apparatus. In addition, according to the wideband omnidirectional antenna unit in the wireless transceiver apparatus provided in this embodiment of the present invention, a radiation patch and a feeding structure may be further disposed on a dielectric substrate, and an antenna unit does not need to be separately processed or installed, so that complexity of a manufacturing process of the wireless transceiver apparatus is reduced, and assembly costs are reduced. Further, the radiation patch and the feeding structure of the antenna unit are similar to a planar structure. Therefore, compared with a three-dimensional structure in the related art, a total volume of the antenna unit is reduced, thereby reducing space occupied by the wireless transceiver apparatus.

An embodiment of the present invention provides a base station. The base station may include at least one wireless transceiver apparatus module provided in the embodiments of the present invention. When the base station includes at least two wireless transceiver apparatus modules, each wireless transceiver apparatus module may be any wireless transceiver apparatus in the foregoing embodiments provided in the present invention. The base station is usually an indoor base station. A base station that uses the wireless transceiver apparatus 30 in the embodiments of the present invention has a wide operating frequency band and desirable omnidirectional performance. The base station may be installed in a stadium or a shopping place, and is configured to provide omnidirectional coverage of radio signals in an indoor area.

Persons of ordinary skill in the art may understand that all or some of the steps of the embodiments may be implemented by hardware or a program instructing related hardware. The program may be stored in a computer-readable storage medium. The storage medium may include: a read-only memory, a magnetic disk, or an optical disc.

The foregoing descriptions are merely embodiments of the present invention, but are not intended to limit the present invention. Any modification, equivalent replacement, and improvement made without departing from the spirit and principle of the present invention shall fall within the protection scope of the present invention.

What is claimed is:

1. An apparatus, comprising:

a metal carrier having at least one groove; and an antenna unit in the at least one groove, wherein the antenna unit comprises a feeding structure in the at least one groove and a radiation patch in the at least one groove, the feeding structure feeds the radiation patch, and the radiation patch is grounded;

wherein the entirety of the antenna unit is disposed within the at least one groove and below a topmost major outside plane of the metal carrier.

2. The apparatus according to claim 1, wherein the at least one groove is located at an edge of the metal carrier.

3. The apparatus according to claim 1, further comprising:

a slot between the feeding structure and the radiation patch, and the feeding structure performs coupling feeding on the radiation patch through the slot.

4. The apparatus according to claim 1, wherein the antenna unit further comprises:

a parasitic structure, wherein the parasitic structure is located on a surface parallel to a bottom surface of the at least one groove, and the parasitic structure is grounded.

5. The apparatus according to claim 4, further comprising:

a slot between the parasitic structure and the radiation patch, wherein coupling feeding is performed between the parasitic structure and the radiation patch through the slot.

6. The apparatus according to claim 4, wherein the antenna unit further comprises:

a first ground pin, wherein a first end of the first ground pin is connected to the parasitic structure, a second end of the first ground pin is connected to the metal carrier, the first ground pin is perpendicular to the bottom surface of the at least one groove, and the parasitic structure is grounded through the metal carrier.

7. The apparatus according to claim 4, wherein:

the parasitic structure is a non-centrosymmetric structure.

8. The apparatus according to claim 7, wherein:

the parasitic structure is a circular sector structure, the radiation patch is a semi-annular structure, and a center of the radiation patch and a center of the parasitic structure are located on a same side of the radiation patch.

9. The apparatus according to claim 1, wherein:

both the radiation patch and the feeding structure are non-centrosymmetric structures.

10. The apparatus according to claim 9, wherein the feeding structure is an E-shaped structure, the E-shaped structure comprises a first vertical strip structure and three first horizontal strip structures, each of the three first horizontal strip structures intersect the first vertical strip structure at an interval, an opening of the E-shaped structure is disposed opposite to the radiation patch, a first one of the three first horizontal strip structures is disposed between a second one of the three first horizontal strip structures and a third one of the three first horizontal strip structures, a length of the first one of the three first horizontal strip structures is greater than a respective length of the second one of the three first horizontal strip structures and the third one of the three first horizontal strip structures, the first one of the three first horizontal strip structures is connected to a feed of the metal carrier, and a slot is between the first vertical strip structure and the radiation patch.

11. The apparatus according to claim 9, wherein the feeding structure is a T-shaped structure, the T-shaped structure comprises a second vertical strip structure and a second horizontal strip structure extending from a middle part of the second vertical strip structure, an end of the second horizontal strip structure is connected to a feed of the metal carrier, and a slot is between the second vertical strip structure and the radiation patch.

12. The apparatus according to claim 9, wherein the feeding structure is an integrated structure comprising an arc-shaped structure and a strip structure, a first end of the strip structure is connected to a feed of the metal carrier, and a second end of the strip structure is connected to the arc-shaped structure, wherein an arc-shaped opening is disposed on a side of the radiation patch nearest to the feeding structure, the arc-shaped structure is in the arc-shaped opening, a slot is between a sidewall of the arc-shaped structure and a sidewall of the arc-shaped opening.

13. The apparatus according to claim 1, wherein the antenna unit further comprises a first dielectric substrate, the first dielectric substrate is disposed in the at least one groove, and the radiation patch and the feeding structure are disposed on the first dielectric substrate.

14. The apparatus according to claim 13, wherein the antenna unit further comprises:

a first ground cable, wherein a first end of the first ground cable is connected to the radiation patch, a second end of the first ground cable is connected to a metal ground cable disposed on the first dielectric substrate, and the radiation patch is grounded through metal ground cable.

15. The apparatus according to claim 14, wherein:

the first ground cable is disposed on a first side of the radiation patch, and the feeding structure is disposed on a second side of the radiation patch different from the first side of the radiation patch.

16. The apparatus according to claim 14, further comprising:

a second ground cable, wherein first and second ground cables are symmetrically disposed on two sides of the radiation patch, and are separately connected to the metal ground cable of the dielectric substrate, the feeding structure is an axisymmetric structure, and a symmetry axis of the feeding structure is the same as a symmetry axis of the first and second ground cables.

17. The apparatus according to claim 13, wherein:

the radiation patch is located on a lower surface of the first dielectric substrate; and the apparatus further comprises:

a second ground pin disposed on at least one side of the radiation patch, wherein a first end of the second ground pin is connected to the radiation patch, a second end of the second ground pin is connected to the metal carrier, the second ground pin is perpendicular to a surface of the first dielectric substrate, the surface of the first dielectric substrate is parallel to a bottom surface of the at least one groove, and the radiation patch is grounded through the metal carrier.

18. The apparatus according to claim 13, further comprising:

a second dielectric substrate on the metal carrier; and the first dielectric substrate and the second dielectric substrate on the metal carrier are an integrated structure.

19. The apparatus according to claim 1, further comprising:

a shielding cover, wherein the shielding cover is buckled on a dielectric substrate on the metal carrier.

20. The apparatus according to claim 1, further comprising:

a second ground pin disposed on a side of the radiation patch, wherein a first end of the second ground pin is connected to the radiation patch, a second end of the second ground pin is connected to the metal carrier, the second ground pin is perpendicular to a bottom surface of the at least one groove, and the radiation patch is grounded through the metal carrier.

* * * * *